United States Patent [19]

Reid

[11] 4,041,674

[45] Aug. 16, 1977

[54] APPARATUS FOR PACKING ARTICLES, SUCH AS BOTTLES

[75] Inventor: Laurie M. Reid, Luthersville, Ga.

[73] Assignee: Anderson Bros. Mfg. Co., Rockford, Ill.

[21] Appl. No.: 652,078

[22] Filed: Jan. 26, 1976

[51] Int. Cl.[2] ..... B65B 21/24; B65B 35/40; B65B 57/20

[52] U.S. Cl. ..... 53/61; 53/159; 53/182 R; 198/419; 198/426; 198/429

[58] Field of Search ..... 53/159, 164, 182 R, 53/61, 62; 198/22 B, 24, 31 AB, 419, 426, 429; 214/6 DK

[56] References Cited

U.S. PATENT DOCUMENTS

| | | | |
|---|---|---|---|
| 1,708,664 | 4/1929 | Danberg | 198/31 AB |
| 2,024,503 | 12/1935 | Bickford | 53/164 X |
| 3,051,292 | 8/1962 | Sundquist et al. | 198/24 X |
| 3,593,488 | 7/1971 | Merkner et al. | 53/164 X |
| 3,594,977 | 7/1971 | Grasvoll | 53/164 X |
| 3,708,947 | 1/1973 | Green et al. | 53/159 X |
| 3,760,553 | 9/1973 | Schmidt et al. | 53/182 X |
| 3,830,036 | 8/1974 | Harkness et al. | 53/182 X |
| 3,914,921 | 10/1975 | Doran et al. | 53/159 |

*Primary Examiner*—Robert Louis Spruill
*Attorney, Agent, or Firm*—Morsbach & Pillote

[57] ABSTRACT

Apparatus for packing articles, particularly bottles, in units each consisting of a plurality of parallel rows of articles, each row comprising a plurality of articles, in side-by-side contact, and with the rows in contact, comprising means for collating articles into said units and sleeve-wrapping the units. Each unit of articles, as formed, is deposited on a conveyor and conveyed thereby through a sealing station, means being provided for supplying webs of heat-sealable wrapping material to lie under and over each unit, and for sealing the webs together at the sealing station to form a sleeve of the material around each unit. In collating cylindrical bottles (or other cylindrical articles), the rows are staggered for nesting of the bottles to reduce the voids in the units.

16 Claims, 44 Drawing Figures

301a
301
163
301b
303
321
B
155
157
161
165
151
P1
P2
R1
R2
159
325
369
365

R1
R2
R3
325
159
369
P1
P2
321
B
155
157
161
165
151

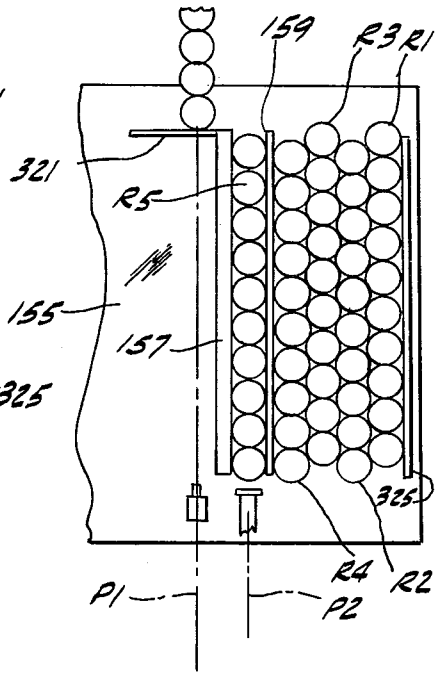
FIG. 13A
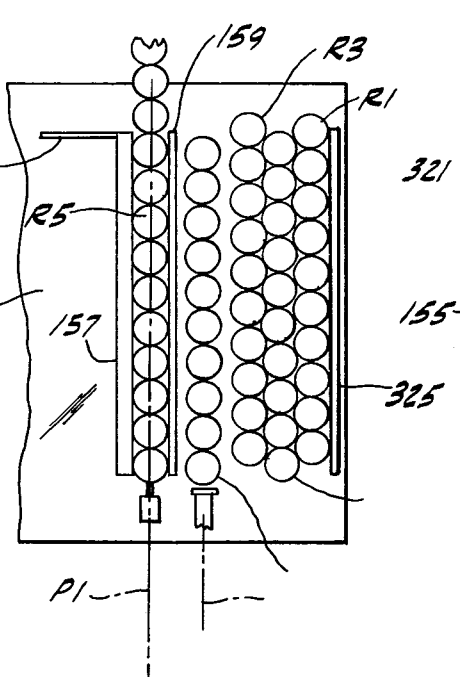
FIG. 12A
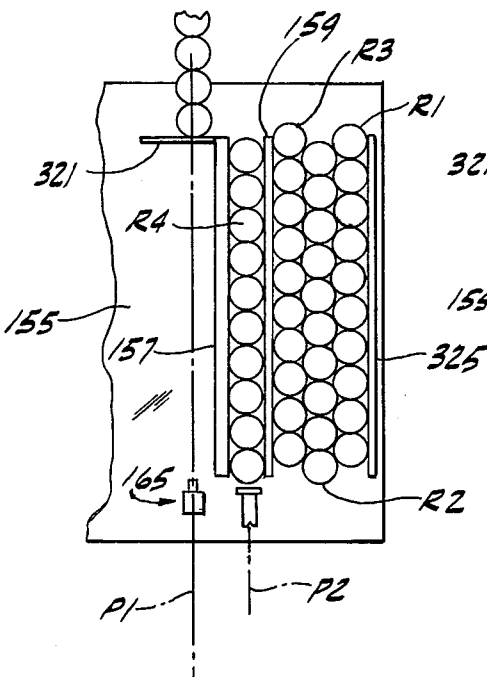
FIG. 11A
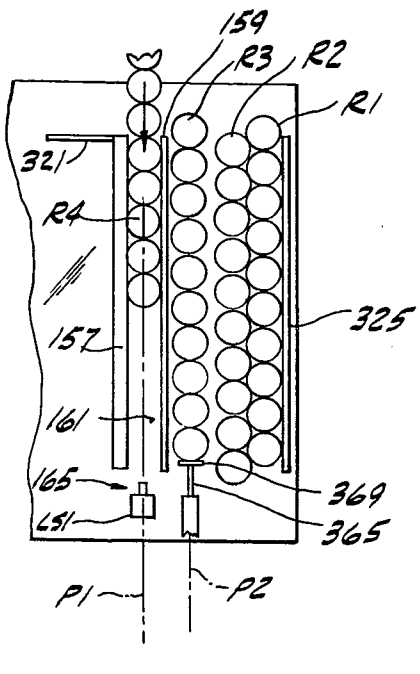
FIG. 10A
FIG. 13
FIG. 12
FIG. 11
FIG. 10

APPARATUS FOR PACKING ARTICLES, SUCH AS BOTTLES

BACKGROUND OF THE INVENTION

This invention relates to apparatus for packing articles, such as bottles, and more particularly to apparatus for collating bottles, or other articles, and shrink-wrapping them.

The invention is especially concerned with apparatus for shrink-wrapping glass bottles, including cylindrical bottles, square bottles and oblong bottles ("blakes"), in lieu of packing the bottles in cartons or trays. The apparatus has been developed primarily for use by bottle manufacturers, and more particularly for use by manufacturers of pharmaceutical and cosmetic bottles, to pack such bottles for shipment to the bottle users, but it is readily adapted for wrapping filled bottles as well as empty bottles for shipment and, in fact, is readily adapted for wrapping articles other than bottles.

SUMMARY OF THE INVENTION

Among the several objects of this invention may be noted the provision of improved apparatus for packing articles, such as bottles, wherein the articles are automatically assembled or collated in sets or units each consisting of a predetermined number of the articles; the provision of such apparatus wherein each unit or set of articles, e.g., bottles, is packaged for shipment without the use of cartons or trays; the provision of such apparatus wherein each unit is shrink-wrapped and forms a self-sustaining package holding the articles in their collated arrangement; the provision of such apparatus wherein each unit is sleeve-wrapped in shrink film; the provision of such apparatus which assembles or collates the articles in units with the articles in each unit arranged in parallel rows, each row comprising a plurality of articles arranged side-by-side, the provision of such apparatus operable on cylindrical bottles or other cylindrical articles to stagger the rows so that the articles in each row are nested in relation to the articles in the adjacent row or rows thereby to minimize the voids in each unit; and the provision of such apparatus which is capable of handling articles of low stability and articles of different size.

In general, apparatus of this invention comprises a pusher for pushing rows of articles forward in a predetermined path generally at right angles to the length of the rows, the pusher being movable forward away from and back to a retracted position. A guide is movable forward and back with the pusher, being spaced forward of the pusher to provide a space for a row of articles therebetween. The guide is movable relative to the pusher between a lowered position at the level of the rows and a raised position above the rows. Articles are fed in through said space from one side of said path when the pusher and guide are in retracted position, the infeed being arrested to provide a row of articles in said space in a first position in front of the pusher. Means is provided for driving the pusher and guide through a forward and return stroke with the guide in its lowered position during the forward stroke whereby the pusher pushes the row of articles in front of the pusher forward to a second position. Means is provided for moving the guide to its raised position for the return stroke so that the guide then clears the articles in said second position.

Other objects and features will be in part apparent and in part pointed out hereinafter.

BRIEF DESCRIPTION OF THE DRAWINGS

FIG. 1A is a plan of the collating means on line 1A—1A of FIG. 1 showing the infeed of a first row of bottles between a pusher and a guide of the collating means to make up a unit of bottles;

FIG. 2 is a fragment of FIG. 1 showing the pushing forward of the first row of bottles by the pusher;

FIG. 2A is a plan of FIG. 2;

FIG. 3 is a view similar to FIG. 2 showing the step of raising the guide for return with the pusher;

FIG. 4 is a view similar to FIGS. 2 and 3 showing the pusher and guide returned with the guide still raised;

FIG. 5 is a view similar to FIG. 4 showing the guide lowered and a second row of bottles being fed in between the pusher and guide;

FIG. 5A is a plan of FIG. 5 showing the first row of bottles being staggered while the second row is being fed in;

FIG. 6A is a plan showing the completion of the second row of bottles;

FIG. 7 is a side elevation showing the first and second rows pushed forward;

FIG. 7A is a plan of FIG. 7;

FIG. 8 is a side elevation showing the pusher and guide returned from the FIG. 7 position and a third row of bottles fed in;

FIG. 8a is a plan of FIG. 8;

FIG. 9 is a side elevation showing the first, second and third rows of bottles pushed forward FIG. 9A is a plan view of FIG. 9;

FIG. 10 is a side elevation showing the pusher and guide returned from the FIG. 9 position and a fourth row of bottles being fed in;

FIG. 10A is a plan of FIG. 10 showing the third row being staggered while the fourth row is being fed in;

FIG. 11 is a side elevation showing the first, second, third and fourth rows of bottles pushed forward;

FIG. 11A is a plan of FIG. 11;

FIG. 12 is a side elevation showing the pusher and guide returned from the FIG. 11 position and a fifth row of bottles (the last row of a unit) being fed in;

FIG. 12A is a plan of FIG. 12;

FIG. 13 is a side elevation showing the first, second, third, fourth and fifth rows (the five rows of a unit) of bottles pushed forward;

FIG. 13A is a plan of FIG. 13;

FIG. 14 is a side elevation showing the pusher and guide returned from the FIG. 13 position, and the fifth row being staggered while another row constituting the first row of the next five-row unit is being fed in;

Corresponding reference characters indicate corresponding parts throughout the several views of the drawings.

DESCRIPTION OF THE PREFERRED EMBODIMENT

Figures 1, 15, 16:
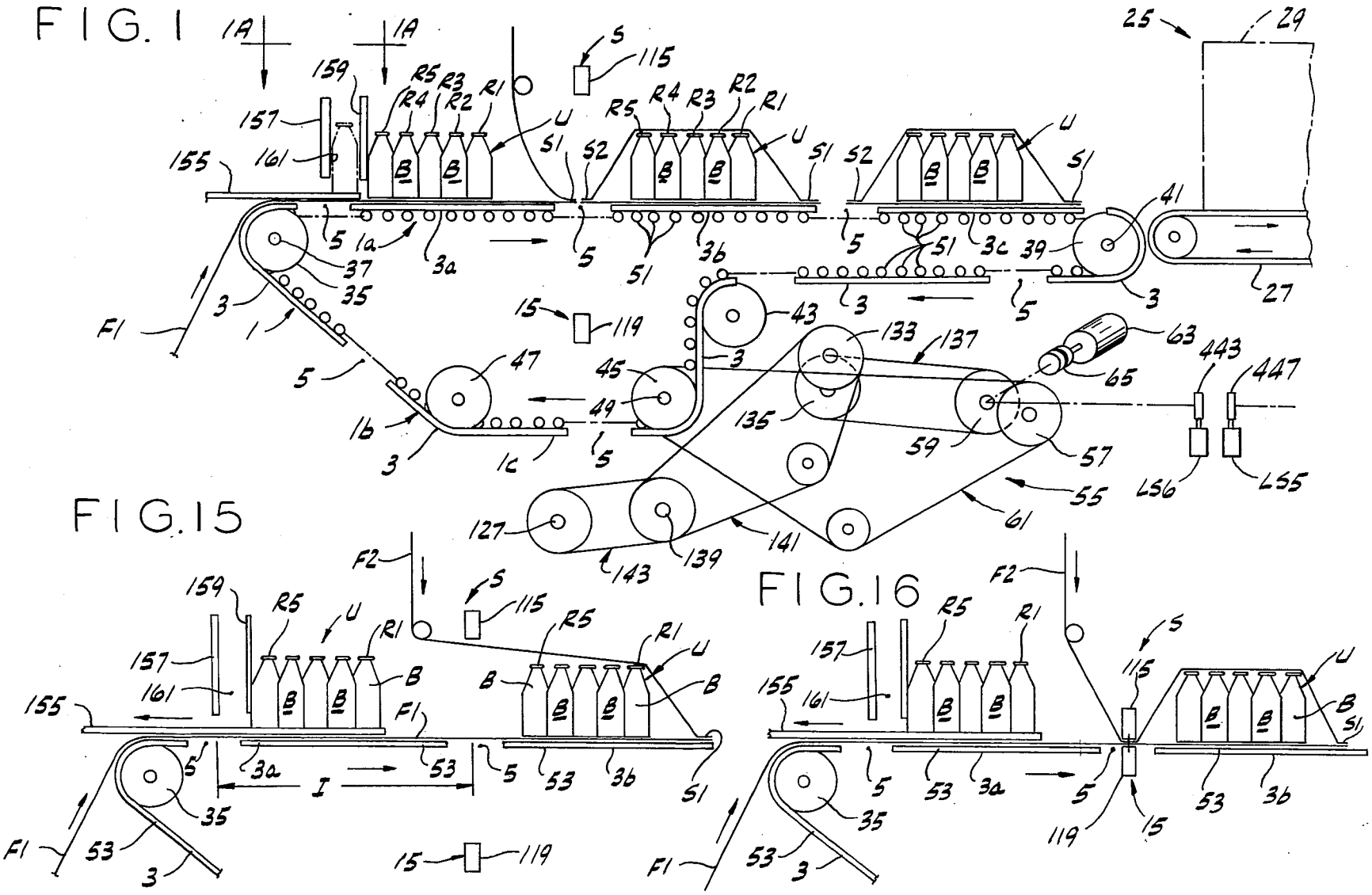
FIG. 1 is a semidiagrammatic view in side elevation showing the collating means, the sleeve-wrapping means and the shrink tunnel means of apparatus of this invention, with units consisting of five rows of bottles in the sleeve-wrapping means.
FIG. 15 is a side elevation showing a collector plate of the collating means ready to be withdrawn to deposit the five-row unit on a conveyor of the sleeve-wrapping means, also showing the sealing station of the sleeve-wrapping means, and a unit downstream from the sealing station which has been wrapped and is about to be sealed at its trailing end.
FIG. 16 is a view similar to FIG. 15 showing the sealing of the wrapping at the sealing station.
Figure 15A:
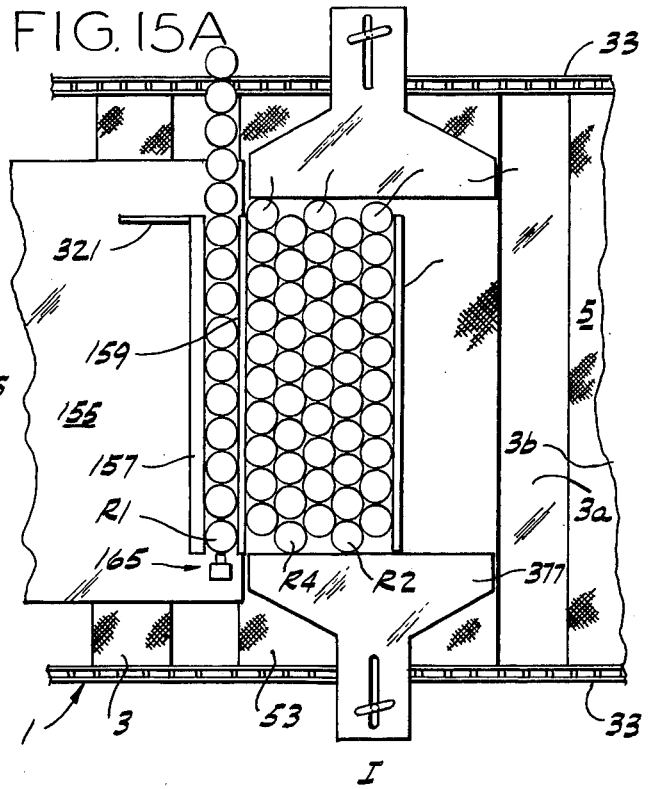
FIG. 15A is a plan of part of FIG. 15 showing the collector plate withdrawn.

Referring to the drawings, first more particularly to FIGS. 1, 15, 15A and 16, apparatus of this invention is shown to comprise an endless conveyor, designated in its entirety by the reference numeral 1, having a generally horizontal upper reach 1*a* for transporting units U of articles to be sleeve-wrapped forward along a generally horizontal path, and a return reach 1*b* below the upper reach 1*a*. The conveyor comprises a series of supports or flights 3 each adapted to hold a unit U to be wrapped (a "packaging unit") spaced at equal intervals I along and throughout the conveyor, with gaps 5 between the flights 3 spaced at intervals I. As illustrated in FIGS. 1, 15 and 16, each unit U consists of a plurality of cylindrical bottles, each bottle being designated B. The bottles are upright, arranged in five transverse rows R1 – R5 of 10 bottles each. As shown in FIG. 15A, the bottles B in each row are in side-by-side contact, and the rows are in contact, with the rows being staggered (in transverse direction in respect to the conveyor 1) so that the bottles B in each row are in nested relation to the bottles in the adjacent row or rows. The staggered or nested pattern may be referred to as a "scroll" pattern; the purpose for the nesting or staggering is, of course, to minimize the voids in the unit, and to prevent "rocking" or loosening after the package has been made, especially during handling and shipment.

The conveyor 1 is intermittently indexed forward (i.e., its upper reach 1*a*is indexed from left to right as viewed in FIG. 1) through a distance equal to one of the intervals I with a dwell successive cycles of operation of the conveyor successively to bring a gap 5 in the upper reach of the conveyor to a sealing station S located along the path of travel of the upper reach of the conveyor whereby, during each dwell of the conveyor, there is a gap 5 at the sealing station S, a flight specially designated 3*a* at a first flight position immediately upstream from the sealing station, a second flight specially designated 3*b* at a second flight position immediately downstream from the sealing station, and a third flight specially designated 3*c* at a third flight position immediately downstream from the flight 3*b* at the stated second flight position. The flight 3*a* at the first flight position is adapted to hold a unit U of bottles to be wrapped and to transport this unit, on indexing of the conveyor, through the sealing station S to the second flight position (at 3*b*); and to transport a unit U from the second to the third flight position (at 3*c*).

Figure 17:
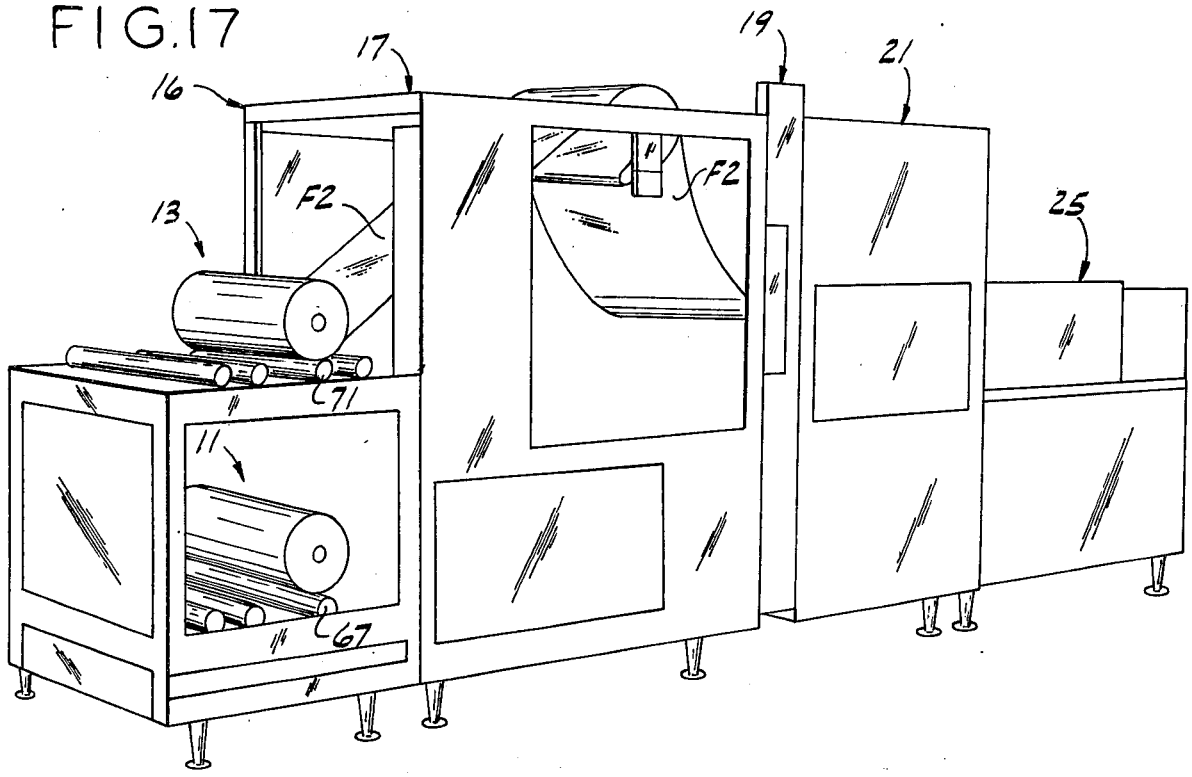
FIG. 17 is a perspective of the entire apparatus, showing its rearward or entrance section, center sealing section, exit or outfeed section, and shrink tunnel section.

At 11 (see FIGS. 17 and 18) is generally indicated means for supplying a first web F1 of heat-sealable heat-shrinkable wrapping material (e.g., polyethylene film) to lie under a unit U on the conveyor in the first flight position (at 3*a*) and as it proceeds to the second flight position (at 3*b*), and at 13 is generally indicated means for supplying a second web F2 of the same material to lie on top of the unit U as it proceeds to the second flight position (at 3*b*). The ends of the webs F1 and F2 are heat-sealed together as indicated at S1. The web Fl extends over the upper reach 1*a* of the conveyor from the trailing end of the conveyor (its left end as viewed in FIG. 1) and thus extends over the upper reach of the conveyor from the flight position 3*a* through the sealing station S to the flight position 3*b*. At 15 (see FIGS. 1, 19 and 20) is generally indicated means for sealing the two webs together at the sealing station S and severing the webs through the seal to form a trailing seal S2 for the webs draped around the unit U at the second flight position 3*b* and a leading seal, i.e., the seal S1, for the unit at the first position 3*a* (see FIGS. 1, 15 and 16). The sealing means is operable through the gap 5 in the upper reach 1*a* of the endless conveyor at the sealing station S during each dwell of the conveyor.

As thus far described, the apparatus is generally similar to the apparatus disclosed in my copending U.S. application Ser. No. 619,897, filed Oct. 6, 1975, entitled Packaging Apparatus.

The apparatus comprises a frame designated in its entirety by the reference character 16 (FIGS. 17 and 18) comprising a rearward or entrance section 17, a center section 19 constituting a sealing section and an exit or outfeed section 21. Bottles are collected or collated into units U in the entrance section by collating means generally indicated at 23. Each unit U, after it has been collated by the collating means, is deposited on the conveyor flight at 3*a*, with the unit on top of the reach of film F1 overlying the flight 3*a*. This flight is located in the entrance section 17 adjacent its forward (downstream) end (its right-hand end as viewed in FIGS. 17 and 18) immediately rearward of (upstream from) the center section 19. When a conveyor 1 is indexed forward through a cycle, the flight which was at 3*a* is indexed forward to the position 3*b*, and the unit on this flight engages the lower end portion of web F2 which is joined to the leading end of the web F1 by the seal S1 and this causes the web F2 to lie on top of the unit as the unit proceeds to the said second position 3*b*, with web F1 underlying the unit and joined to web F2 at the forward end of the unit by the seal S1. The sealing means 15 (in the center section 19) is then operable to seal the webs F1 and F2 together behind the unit U which is on the conveyor flight at 3*b* and to sever the webs through the seal to form a trailing seal S2 for the webs draped around the unit which is at position 3*b* and a leading seal, i.e., the seal S1, for the next unit. The sealing means is operable through the gap 5 in the upper reach 1*a* of the conveyor at the sealing station S in the center section 19 during a dwell of the conveyor.

The upper reach 1*a* of the conveyor extends forward from the center section 19 through the outfeed section 21 to a shrink tunnel section 25. On each cycle of the conveyor 1, the flight which was at 3*b* in the outfeed section 21 (the second position) is indexed forward to the third position 3*c* which is in the outfeed section adjacent its forward (downstream) end, and a unit which was at this position 3*c* is conveyed forward and transferred to a continuously travelling conveyor 27 in the shrink tunnel 29 of section 25 for being conveyed through the shrink tunnel to shrink the film which has been enwrapped around this unit. Means indicated generally at 31 (see FIGS. 29 and 30) is provided in the outfeed section 21 for sealing the ends of the wrapper or sleeve of film which is enwrapped around the unit on the flight at position 3*c,* prior to entry of the enwrapped unit in the shrink tunnel.

The conveyor 1 is generally similar to the conveyor 1 shown in the aforesaid U.S. application Ser. No. 619,897, comprising a pair of side chains such as indicated at 33 trained around a system of sprockets including a pair of sprockets 35 on a horizontal shaft 37 journalled in section 17 adjacent its forward (downstream) end and a pair of sprockets 39 on a horizontal shaft 41 journalled in the outfeed section 21 adjacent its forward end. The upper reach 1*a* of the conveyor 1 travels forward in a horizontal path from sprockets 35 to sprockets 39 and the return reach 1*b* of the conveyor travels back from sprockets 39 to sprockets 35 guided by sprockets such as indicated at 43, 45 and 47 to dip down below the sealing station S in the sealing section 19 to accommodate certain components of the sealing means 15 in the sealing section, as will appear. The shaft carrying sprockets 45 is designated 49. Each of the supports or flights 3 of the conveyor 1 is constituted by a set of bars 51 extending between the side chains 33 of the conveyor with means such as a panel of flexible wire mesh 53 forming a flexible platform on the bars. Suitable tracks (not shown) may be provided for supporting the upper reach 1*a* of the conveyor between the sprockets 35 and 39.

The means for intermittently indexing the upper reach 1*a* of conveyor 1 forward through a distance equal to the interval I is indicated generally at 55 (see FIG. 1). It comprises a chain and sprocket drive mechanism corresponding generally to the chain and sprocket drive mechanism shown in my aforesaid U.S. patent application Ser. No. 619,897 and in U.S. Pat. No. 3,927,507, issued Dec. 23, 1975, including a sprocket 57 (corresponding to sprocket 15 shown in said U.S. Pat. No. 3,927,507) fixed in offset relation to a sprocket 59 with a chain drive 61 from sprocket 55 to the shaft 49 for driving the conveyor. Sprocket 57 is adapted to be driven in single revolution cycles by a motor 63 acting through an electrically controlled single revolution clutch 65. The arrangement is such that on each revolution of the sprocket 59, the sprocket 57, rotating around the axis of sprocket 59 without rotating around its own axis, generates an intermittent motion of the conveyor 1 (with smooth start and stop enabling the conveyance of bottles of low stability without having them fall over), and indexes the upper reach 1*a* of the conveyor forward through the distance I with a dwell between successive cycles of operation, as will appear, successively to bring a first flight 3 of the conveyor 1 from position 3*a* to position 3*b* and a second flight from position 3*b* to position 3*c,* and to bring a gap 5 in the upper reach 1*a* of the conveyor to the sealing station S.

Figure 18:
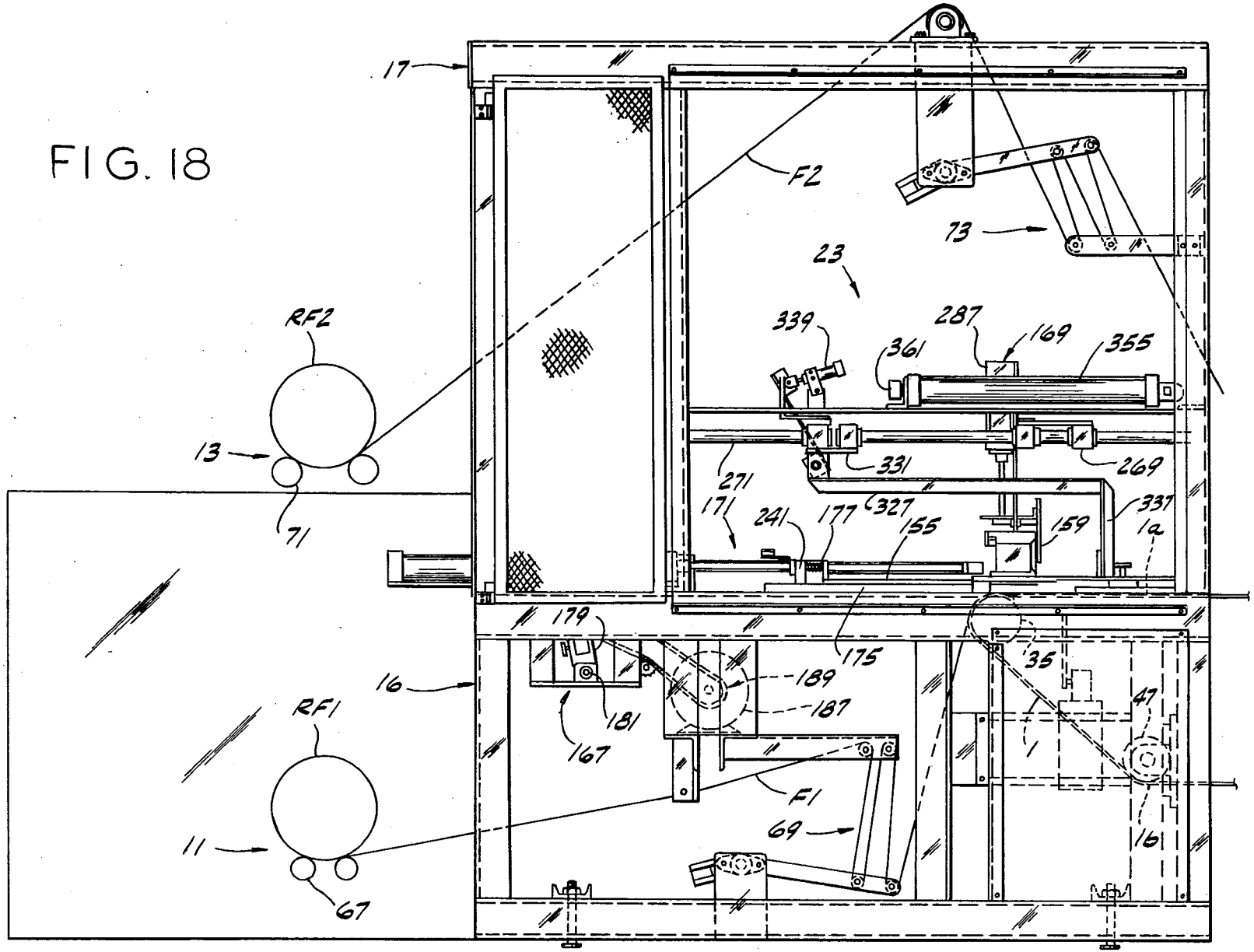
FIG. 18 is a side elevation of the entrance section.

The means 11 for supplying the first web F1 of heat-sealable wrapping material to lie under a unit U as it proceeds from the 3*a* to the 3*b* position comprises a lower roll holder 67 mounted at the rear of section 17. The web F1 is fed forward from a roll RF1 in the roll holder as indicated generally at 69 to the trailing end of the upper reach 1*a* of conveyor 1, leading up and around the conveyor at its rearward (entry) end and then forward over the upper reach 1*a* of the conveyor as shown in FIGS. 1 and 18. The means for supplying the second web F2 of heat-sealable wrapping material to lie on top of a unit U as it proceeds to the second position 3*b* comprises an upper roll holder 71 mounted at the rear of section 17 and means indicated generally at 73 for guiding the web F2 from a roll RF2 in the holder 71 to extend down in front of a unit U at position 3*a* and to proceed forward on top of this unit as it moved forward from position 3*a* to position 3*b* (see FIGS. 1 and 18).

Figure 19:
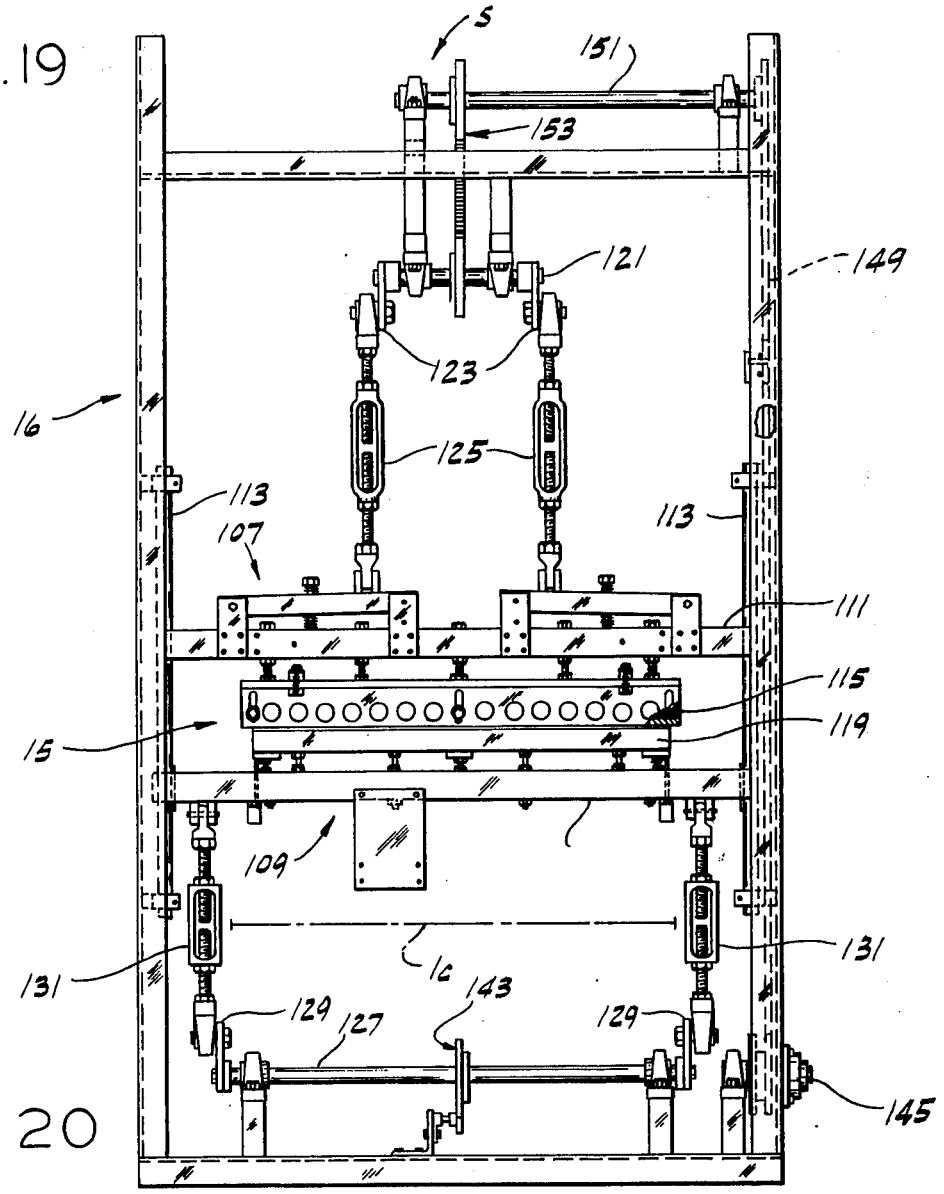
FIG. 19 is a view showing the sealing section.
Figure 20:
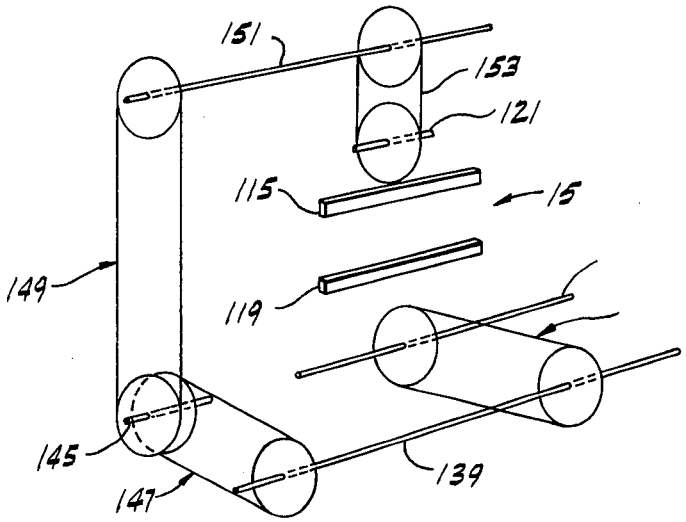
FIG. 20 is a diagrammatic view showing drive mechanism for an anvil and sealing bar of the sealing section.

The means 15 for sealing the webs F1 and F2 together comprises upper and lower horizontal sealing bar assemblies 107 and 109 corresponding generally to the horizontal sealing bar assemblies 107 and 109 shown in my aforesaid U.S. Pat. No. 3,927,507, these sealing bar assemblies extending transversely of the apparatus in section 19 at the sealing station S and being vertically movable toward and away from one another in a vertical transverse plane at the sealing station. The upper assembly 107 comprises a horizontal bar 111 (see FIG. 19) mounted for vertical sliding movement on a pair of vertical guide rods 113 at opposite sides of section 19 and an anvil 115 carried by the bar at its bottom. The lower assembly 109 comprises a horizontal bar 117 also mounted for vertical sliding movement on the rods 113, and a sealing bar 119 on top of bar 117 having an electrical resistance heater and a cutting blade (see my aforesaid U.S. Pat. No. 3,927,507 for details) incorporated therein. The length of the sealing bar 119 is somewhat less than the length of a gap 5 in the conveyor 1 (i.e., less than the distance between the chains 33 of conveyor 1) so that this bar 119 may move up and down through a gap 5 as will appear. Means is provided for moving the anvil 115 down and the seal bar 119 up from an open retracted position (wherein the anvil is raised and the seal bar is lowered) into engagement with one another for sealing and severing the film, and then moving the anvil back up and the sealing bar back down to their respective retracted positions. This means comprises an upper crankshaft 121 (in section 19) having cranks 123 connected by links 125 to the bar 111 carrying the anvil 115, and a lower crankshaft 127 (at the bottom of section 19) having cranks 129 connected by links 131 to the bar 117 carrying the sealing bar 119. The upper and lower crankshafts 121 and 127 are intermittently driven through a one-revolution cycle by a chain and sprocket drive mechanism similar to the chain and sprocket mechanism for driving the sealing bar assemblies shown in my aforesaid U.S. Pat. No. 3,927,507 including a sprocket 113 (corresponding to sprocket 175 of said patent) fixed to a sprocket 135 (corresponding to sprocket 171 of said patent). Sprocket 135 is driven via a chain and sprocket drive 137 from the drive for sprocket 59. Sprocket 133 drives a shaft 139 via a chain and sprocket drive 141. Shaft 139 drives the lower crankshaft 127 via a chain and sprocket drive 143. Shaft 139 also drives a shaft 145 via a chain and sprocket drive 147 and shaft 145 drives the upper crankshaft 121 via a chain and sprocket drive 149, a shaft 151, and a chain and sprocket drive 153. A portion 1c of the lower reach of conveyor 1 passes through the sealing station S below its upper reach 1a. The lower sealing bar assembly 109 is located above portion 1c, this portion passing between the links 131 as shown in FIG. 19.

Figures 1A, 2, 2A, 3, 4, 5, 5A:
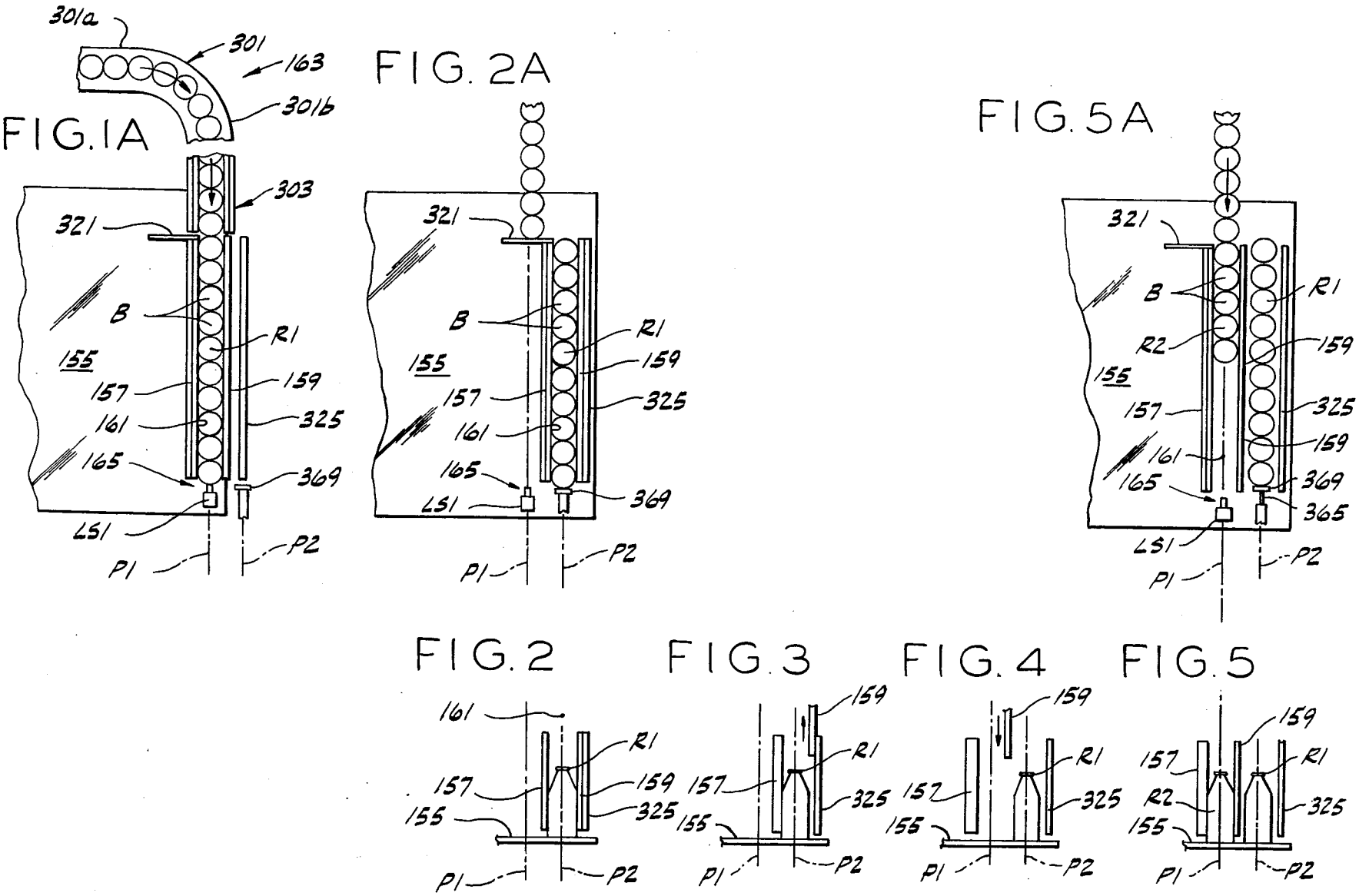

The collating means 23, which is located in section 17 of the apparatus, comprises means constituted by a plate 155 for supporting bottles B for arrangement thereof in the rows, and a pusher 157 for pushing the rows of articles on this plate forward in a predetermined path generally at right angles to the length of the rows. This path is directly in line with the path of travel of the upper reach 1a of the conveyor 1. The pusher 157 is movable forward along this path from the retracted position in which it is illustrated in FIGS. 1, 4, 5, 8, 9, 10, 12 and 14 through a forward stroke which is somewhat greater than the bottle diameter and back through a return stroke to its retracted position. A guide 159, which may be called the row guide, is movable forward and back with the pusher 157, being spaced forward of the front (forward) face of the pusher a distance slightly greater than the bottle diameter and hence such as to provide a space or passage 161 for a row of bottles between the pusher 157 and the guide 159. The guide is also movable vertically relative to the pusher between the lowered operative position in which it is illustrated in FIGS. 1, 2, 5 and 7–13 at the level of the rows and the raised position above the rows in which it is illustrated in FIGS. 3 and 4.

At 163 is generally indicated means for feeding bottles in single file one after another over the bottle-supporting plate 155 from one side of the path of forward movement of the rows through the space 161 between the pusher 157 and the guide 159 when the pusher and guide are in retracted position. Means indicated generally at 165 is provided for arresting the feed of the bottles to provide a row of bottles on the bottle-supporting plate 155 in said space 161 in a first position P1 in front of the pusher. At 167 is generally indicated means for driving the pusher and guide through a forward stroke during which the guide may be in its lowered position whereby the pusher pushes the row of bottles in front of the pusher forward to a second position P2 and the guide pushes forward each row or rows ahead of the guide. At 169 is generally indicated means for moving the guide to its raised position for the return stroke of the pusher and guide so that, on the return stroke of the pusher and guide the guide clears the bottles in the second position P2. In this way a plurality of rows of bottles is provided, one following another, and pushed forward to form a unit U consisting of said plurality (five rows of 10 bottles each as shown in FIGS. 1, 15, 15A and 16).

Figure 22:
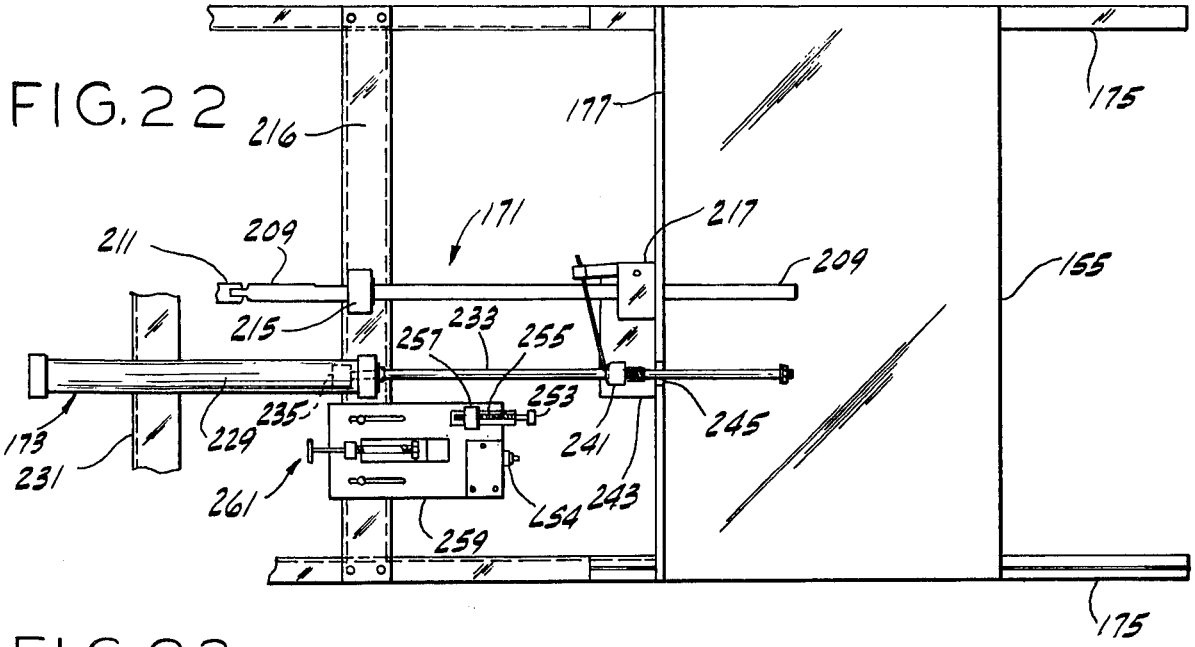
FIG. 22 is a plan showing certain operating mechanism for the collector plate of the collating means.
Figure 23:
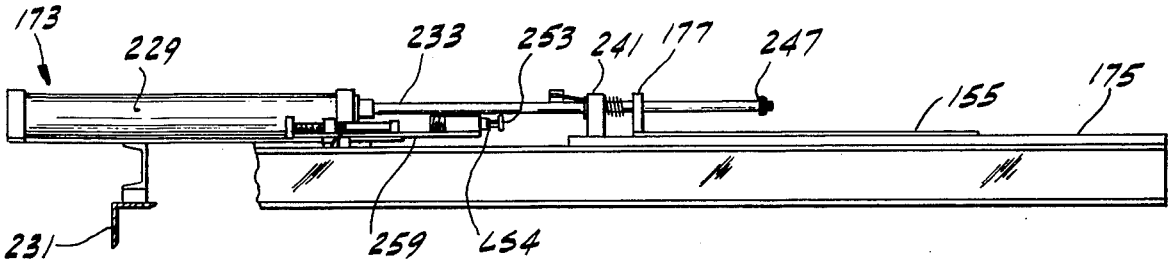
FIG. 23 is a side elevation of FIG. 22.

The bottle-supporting plate 155, which may also be referred to as the collector plate, is movable forward along the same path as the pusher 157 (i.e., the path of the upper reach 1a of the conveyor 1) on each forward stroke of the pusher and guide 159. It is retractable to the retracted position in which it is illustrated in FIG. 1 wherein it extends forward over the trailing (rearward) end of the upper reach 1a of the conveyor 1 with its forward end adjacent the trailing end of the flight at 3a of the conveyor 1. At 171 (see FIGS. 18 and 22) is generally indicated means for driving the collector plate 155 forward through a predetermined stroke on each forward stroke of the pusher 157 and guide 159, and at 173 (see FIGS. 22 and 23) is generally indicated means which is operable after completion of a unit U on the plate 155 to retract the plate 155. The latter is slidable longitudinally of the apparatus on a pair of rails 175 in section 17. At its rearward end (its upstream or trailing end) it has an upwardly extending bar 177.

Figure 23A:
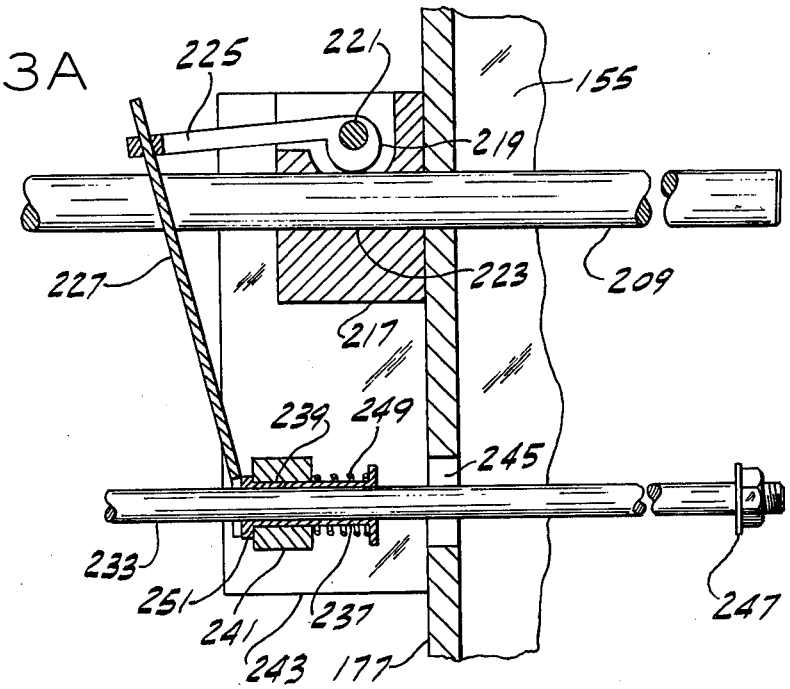
FIG. 23A is an enlarged detail of certain parts shown in FIGS. 22 and 23.

The means 171 for driving the collector plate 155 forward comprises a crank 179 (see FIG. 25) pivoted at 181 on a bracket 183 in section 17 for swinging movement on a horizontal axis extending transversely of the apparatus. The crank is adapted intermittently to be driven clockwise as viewed in FIG. 25 through a forward stroke, followed by a return stroke, by means comprising a continuously driven electric motor M2, an electrically actuated single-revolution clutch 185 having its input continuously driven by the motor via a speed-reducer 187 (a gear box) and a chain and sprocket drive 189, and having its output driving a shaft 191 for driving the crank. A torque limiter for the drive is indicated at 193. The shaft 191 is journalled in bearings 195 and has a crank block 197 at its end opposite the clutch 185 carrying a pin 199 rotary in a block 201 slidable along the length of the crank in a slot 203 in the latter. The throw of the crank block 197 is adjustable via a knob 205 to adjust the throw of the crank 179. A cap 207 is fixed on the upper end of the crank. A rod 209 is connected to the crank by a link 211 for being reciprocated through a forward stroke and then back through a return stroke on each oscillation of the crank. The link is pinned at 213 to the crank just below the upper end of the crank (i.e., just below the cap 207). The rod 209 extends forward from the link 211 through a guide 215 mounted on a crossbar 216 in section 17 and thence through a guide 217 on the back of the collector plate bar 177 and through a hole in this bar. Associated with the guide 217 is a one-way coupler 219 which is adapted on a forward stroke of the rod 209 to couple the collector plate 155 to the rod 209 for forward movement of the collector plate a distance corresponding to the forward stroke of the rod, and to uncouple the collector plate from the rod on the return stroke of the rod for return of the rod without return of the collector plate. This one-way coupler, as shown in FIGS. 23A, comprises an eccentric pivoted at 221 in the guide 217 and engageable by the rod 209 on a forward stroke of the rod to be swung slightly counter-clockwise as viewed in FIG. 23A to grip the rod between the eccentric and the side of the passage 223 in the guide opposite the eccentric. On a return stroke of the rod, the eccentric is swung slightly clockwise to free the rod from the guide for return of the rod without returning the collector plate. An arm 225 extends rearward from the eccentric and has a finger 227 at its rearward end for a purpose to be described.

The means 173 for retracting the collector plate comprises an air cylinder 229 extending longitudinally of the apparatus having its forward end mounted on the cross bar 217, with additional support therefor in section 17 as indicated at 231. A rod 233 extends forward from a piston 235 in this cylinder through a tubular slide 237 slidable in a hole 239 in a block 241 on a bracket 243 extending rearward from the collector plate 155 and thence through a notch 245 in the collector plate bar 177. The rod 233 has a head 247 on its forward end smaller than the notch 245. The slide 237 is axially slidable in its hole 239 in the block 241 and is biased forward by a spring 249 for engagement of a head 251 at its rearward end with the rearward face of the block. When the rod 233 is retracted, head 247 is adapted to pass through the notch 245 for engagement with the forward end of slide 237 to move the slide rearward relative to the block 241 and then to move the collector plate 155 rearward. The finger 227 extends behind the head 251 of the slide so that, when the slide is moved rearward relative to the block 241, the eccentric 219 is released to free the collector plate 155 from the rod 209 for retraction of the collector plate.

The retracted position of the collector plate 155 is determined by engagement of the collector plate bar 177 with a stop 253 which may be yieldable against a spring (not shown) in a retainer 255 to constitute a shock absorber. The retainer is adjustably threaded in a block 257 on a bracket 259 carried by the bar 216, this bracket being longitudinally adjustable on the bar 216 via suitable means such as indicated at 261. The bracket carries a switch LS4 actuable by the collector plate bar 177 on retraction of the collector plate 155.

Figure 28:
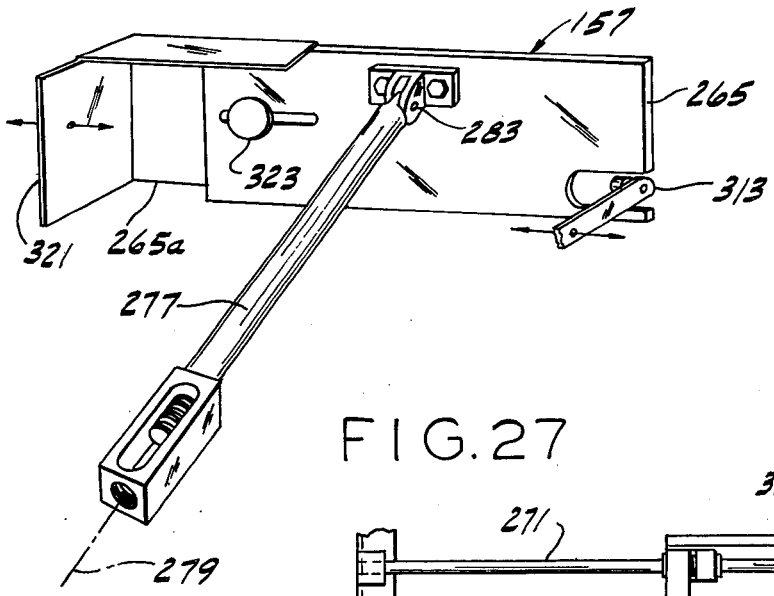
FIG. 28 is a perspective showing certain details re the pusher of the collating means.
Figure 27:
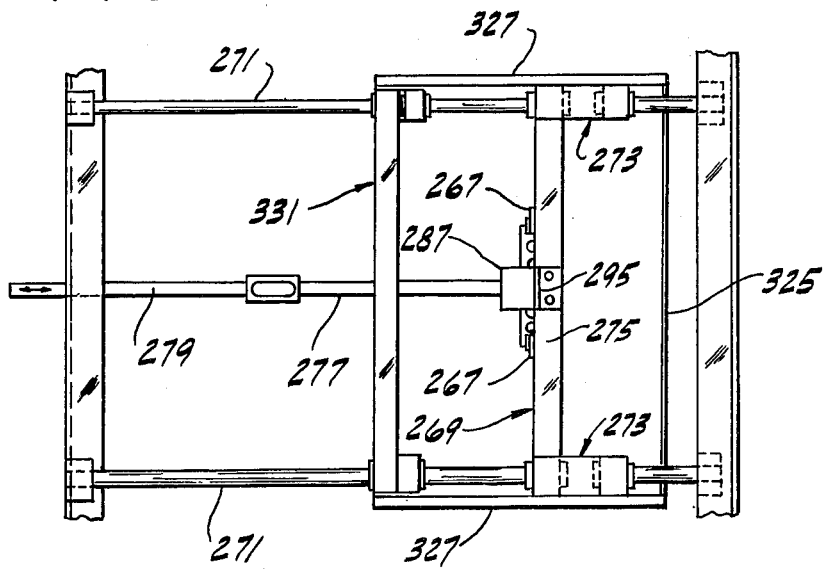
FIG. 27 is a plan showing certain details of the collating means.
Figure 26:
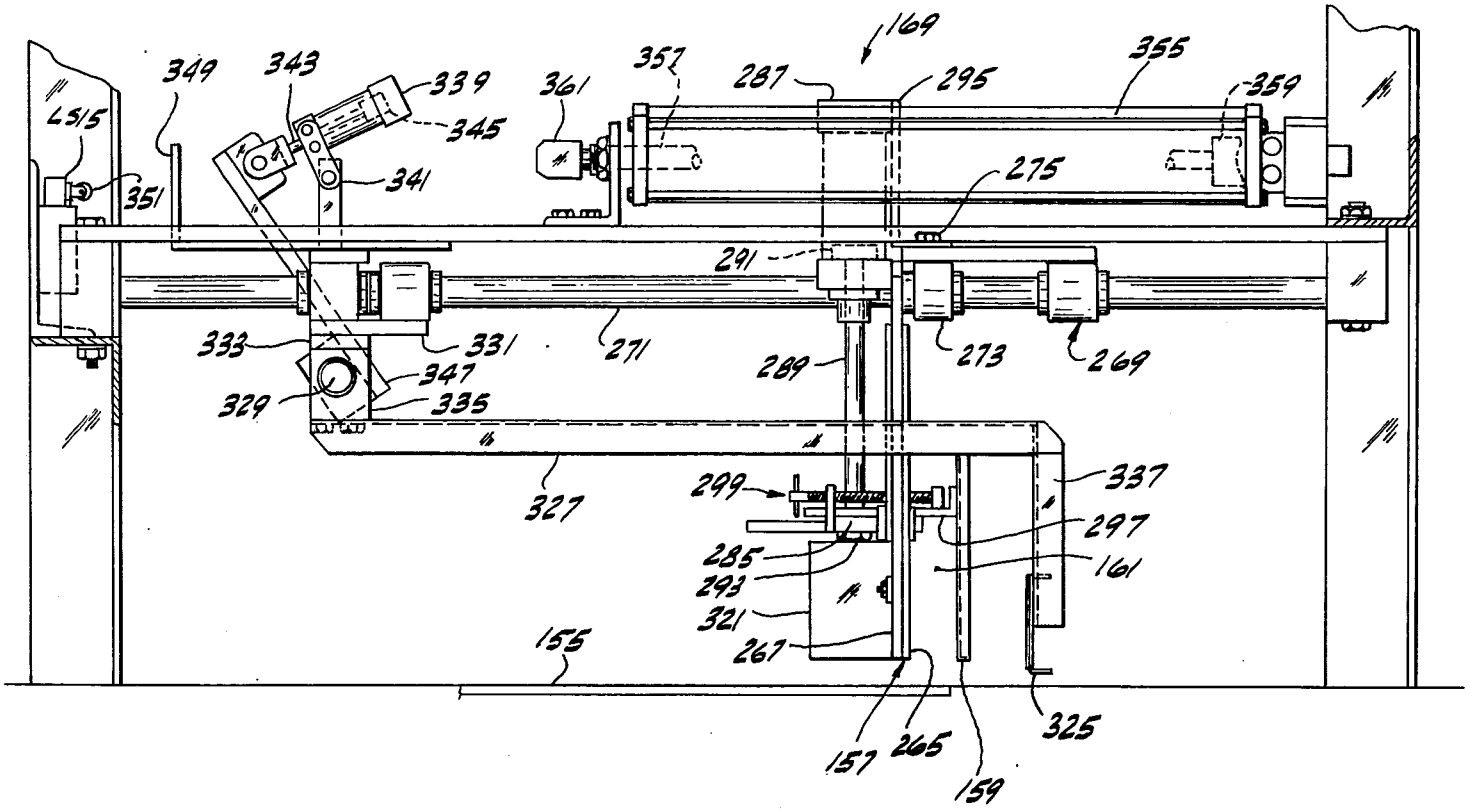
FIG. 26 is a side elevation showing certain details of the collating means.

The pusher 157 comprises a plate 265 secured in vertical position extending transversely of the apparatus to a pair of legs 267 which extend down from a carriage 269 slidable longitudinally of the apparatus on a pair of horizontal guide rods 271 (see FIGS. 26 and 27) mounted in section 17. The carriage comprises a pair of slides, one on each rod 271 and each designated 273, and a bridge 275 extending between these slides. Legs 267 extend down from this bridge. A rod 277 connects the crank 179 and the pusher 157 for reciprocating the pusher through a forward stroke and then a return stroke on each cycle of the crank. This connecting rod 277 has a rear end section 279 pinned to the cap 207 of the crank at 281 and is pinned to the pusher at 283 (see FIG. 28). The pin connection 281 of the rod 277 to the crank 179 is spaced outwardly of the pin connection 213 of link 211 to the crank so that the stroke of the pusher 157 is somewhat greater than the distance through which the collector plate 155 is driven forward on a forward stroke of the crank 179 and the rod 209.

The guide 159 is carried by an auxiliary carriage 285 mounted for vertical movement between the legs 267 above the pusher 157. The auxiliary carriage 285 is vertically movable via an air cylinder 287 secured in vertical position to the main carriage 269 and having a piston rod 289 extending down from the piston 291 therein through the lower end of the cylinder to a connection at 293 with the auxiliary carriage. The cylinder is secured at its upper end to a bracket 295 on the main carriage. The guide 159 comprises a plate secured in vertical position extending parallel to the pusher on the forward end of a bracket 297 which is adjustable forward and rearward on the auxiliary carriage 285, suitable means such as indicated at 299 being provided to effect this adjustment (to handle bottles of different sizes).

Figure 25:
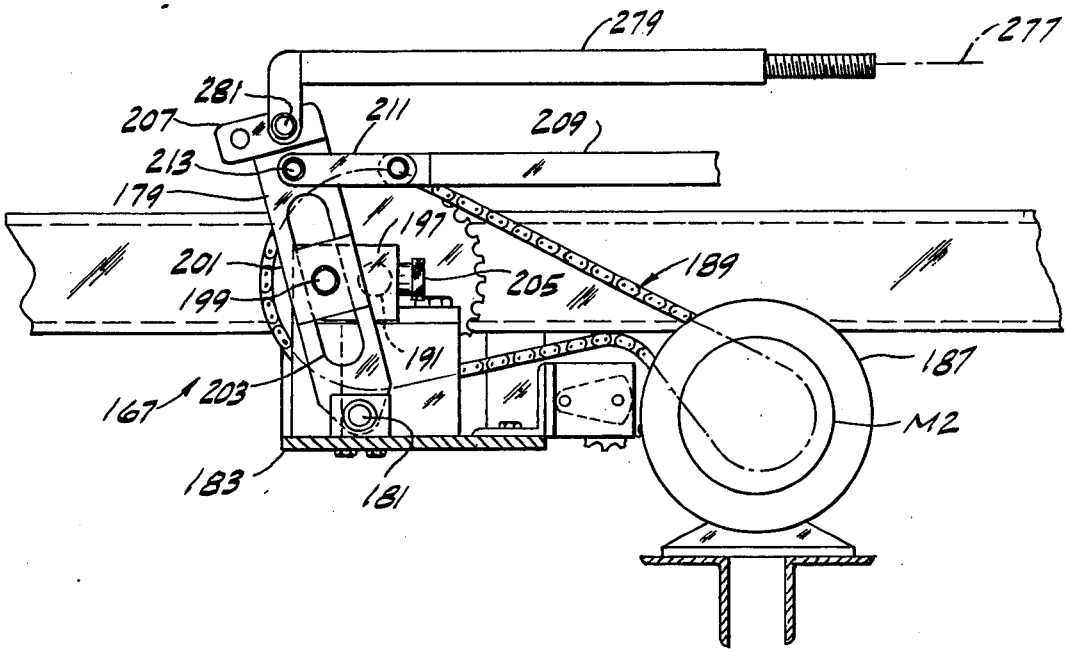
FIG. 25 is a side elevation of FIG. 24.

During each dwell interval between its successive cycles of operation, the crank 179 occupies the retracted position swung to the left in which it is illustrated in FIG. 25. Accordingly, the pusher 157 occupies the retracted position to the left in which it is illustrated in FIG. 1, for example. The guide 159 is adjusted in horizontal direction relative to the pusher so that the space 161 between the pusher and guide is slightly greater than the diameter of the bottles to be handled to constitute a passage for a single row of bottles at the aforesaid first position P1 immediately in front of the pusher. The means 163 for feeding bottles comprises an endless infeed conveyor 301 (see FIGS. 1A) having a portion 301*a* extending alongside the apparatus and a portion 301*b* extending toward the apparatus from one side thereof with the latter portion in line with the space or passage 161 in position P1. This infeed conveyor, which is continuously driven in the operation of the apparatus, has an upper bottle-supporting reach travelling in the direction to carry bottles one after another toward the stated side of the apparatus (which is its left side in respect to the direction of forward movement of the rows of bottles through the apparatus). The upper reach of the infeed conveyor is flush with the collector plate 155 and is adapted to deliver bottles one after another on to the collector plate from the left side of the collector via a guide 303 carried by a bracket 305 (see FIG. 21) extending from a bridge member 307 in section 17. This bracket is longitudinally and laterally adjustable as indicated at 309 for longitudinal and lateral adjustment of the guide 303.

Bottles are placed standing upright on the upper reach of the infeed conveyor 301 and are fed forward by the infeed conveyor to the guide 303 from the left side of the apparatus and thence through the space or passage 161 between the pusher 157 and the guide 159. With the infeed conveyor 301 continuously driven, bottles advancing on to the collector plate 155 from the left side are pushed over the collector plate in single file via the guide 303 and thence through the passage 161 (at position P1) until the feed of the bottles through the passage 161 is arrested thereby to provide a row of bottles on the collector plate extending transversely of the apparatus in the passage 161 in front of the pusher 157. Means for arresting the feeding of the bottles through the passage 161, as indicated generally at 165, comprises stop means located at the right end of passage 161 opposite its left (entrance) end engageable by the leading bottle of the bottles being fed over the collector plate 155 through the passage 161. More particularly, this stop means comprises the operating arm 313 of a switch LS1 carried by a bracket 317 extending from the bridge member 307, this bracket being longitudinally and laterally adjustable as indicated at 319 for longitudinal and lateral adjustment of the switch (and hence its operating arm). When the leading bottle B engages the operating arm 313, the infeed of the bottles is arrested. The infeed conveyor 301 remains in operation, however, its upper reach simply sliding by under the bottles standing on the upper reach. On engagement of the leading bottle with the operating arm 313, the switch LS1 is actuated to effect energization of the single-revolution clutch 185 with resultant operation of crank 179 through a forward and return operation of crank 179 through a forward and return stroke (one cycle) and hence operation of the pusher 157 (and guide 159) through a forward and return stroke (one cycle) and indexing of the collector plate 155 through a forward stroke. The pusher 157 thereupon pushes forward the row of bottles in front of the pusher from position P1 to position P2, and the guide 159 pushes forward the row or rows in front of the guide. As the pusher moves forward and pushes the row of bottles from the P1 to the P2 position, a gate 321, which extends rearward from the left end of the pusher 157, comes in front of the exit end of the guide 303 to cut off the further infeed of bottles by the infeed conveyor 301 until the pusher returns to its retracted position, with accompanying retraction of the gate 321 to open up the exit end of the guide 303 for resumption of the feed of bottles through the passage 161 at position P1 to form the next succeeding row of bottles. The number of bottles in each row is determined by the length of the pusher 157 (i.e., its dimension transversely of the apparatus). To enable the formation of rows of different numbers, the pusher is made adjustable in length as by having a slidably adjustable extension 265*a* of plate 265 with means such as indicated at 323 for holding the extension in adjusted position. Gate 321 is on the extension.

At 325 is indicated a front stop ahead (forward) of the guide 159 engageable by the leading row of bottles and movable forward from a rearward retracted position by bottles being pushed forward by the guide 159. This stop comprises a plate extending transversely of the apparatus between a pair of arms 327 pivoted as indicated at 329 on a carriage 331 slidable on the rods 271 at the rear of the carriage 269. The pivot at 329 comprises a horizontal shaft extending transversely of the apparatus supported in bearing blocks 333 carried by the carriage 331. The arms are secured to the shaft as indicated at 335 extending forward therefrom on opposite sides of the carriage 269, and have downwardly extending forward ends 337 carrying the front stop 325. The latter is adapted to occupy a lowered operative position in front of and at the level of the lowered guide 159 (the level of the pusher), as shown in FIGS. 1–5 and 26. Means is provided for swinging the arms 327 upwardly to raise the stop 325 to a retracted position above and clear of bottles B on the collector plate 155, this means comprising an air cylinder 339 mounted on the carriage 331 as indicated at 341 having a piston rod 343 extending from a piston 345 therein connected to an arm 347 on the shaft. The arrangement is such that with the piston 345 and piston rod 343 retracted, the arms 327 are down and the front stop 325 is down in its operative position wherein it is engageable by the leading row of bottles on the collector plate 155, and is adapted to be pushed forward (via the sliding of the carriage 331 on the rods 271) by the bottles as the bottles are pushed forward by the guide 159. On extending the piston rod 343, the arms 327 are swung up to swing the stop 325 up from in front of the bottles to a raised position clear of the bottles.

The front stop 325 (and its carriage 331) move forward as the bottles are accumulated in rows to form a unit U on the collector plate 155 and, after completion of a unit, the front stop is raised to clear the bottles and returned rearward to its retracted position, which is determined by engagement of an upwardly extending lug 349 on the carriage 331 with the operating member 351 of a switch LS15. Means for moving the front stop 325 to its rearward retracted position is shown to comprise an air cylinder 355 mounted in section 17 extending longitudinally of the apparatus having a piston rod 357 extending out of the rear end of the cylinder from a piston 359 therein, with a head 361 on the end of the piston rod engageable with the lug 349 to drive the front stop carriage 331 rearward. The piston rod 357 is normally retracted so that the head 361 is normally in the retracted position illustrated in FIG. 26. When the carriage 331 is retracted, the lug 349 is spaced rearward of the head 361. As the front stop 325 and its carriage 331 progress forward, the lug 349 approaches the head 361. After completion of a unit U, as will appear, the front stop 325 is raised and cylinder 355 is operated to extend the piston rod 357 rearward, and the head 361 on the piston rod engages the lug 349 and thereby drives the carriage 331 rearward to retract the front stop.

Figure 21:
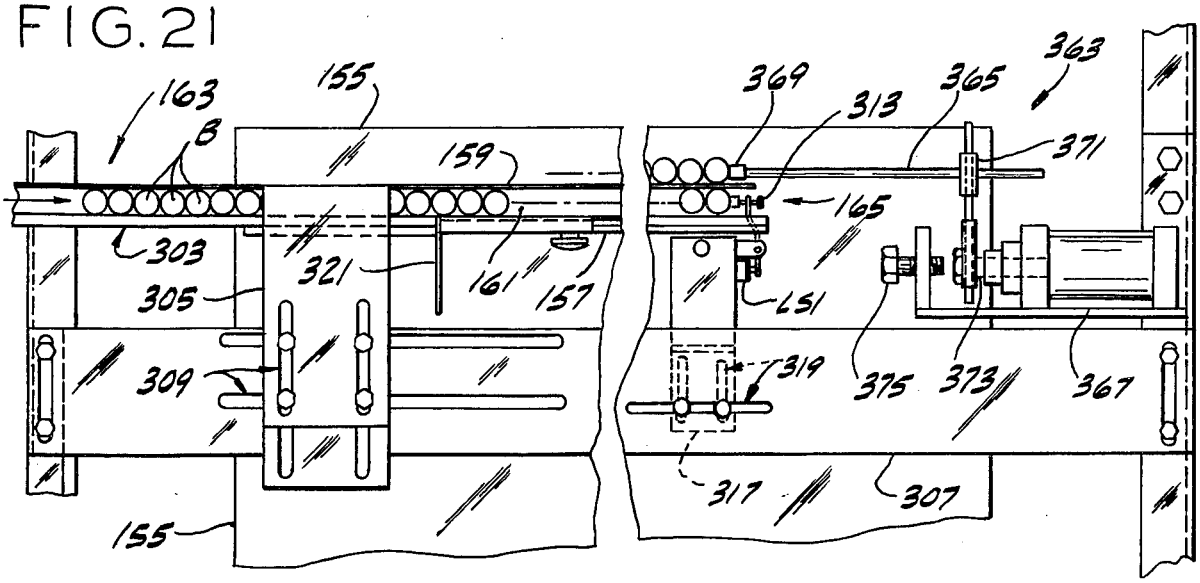
FIG. 21 is a plan of part of the collating means, showing the pusher and guide thereof.

Means indicated generally at 363 in FIG. 21 is provided for operation on alternate rows of bottles at position P2 to move a row of bottles which is at position P2 in the direction of its length back across the collector plate 155 (i.e., toward the left side of the apparatus as viewed in downstream direction) such a distance in relation to the diameter of the bottles as to stagger the rows for nesting. As shown, this means 363 comprises a push rod 365 operable by an air cylinder 367. The push rod has a head 369 engageable with the right end of the row at position P2 to push the row to the left, and is adjustably mounted as indicated at 371 at the forward end of the piston rod 373 of cylinder 367. At 375 is indicated an adjustable stop for engagement by the end of the piston rod to determine its forward stroke. The stop is adjusted to make the forward stroke of the piston rod 373 and the push rod 365 such as to push a row of bottles at P2 toward the left a distance corresponding to one-half the bottle diameter. The cylinder 367, which may be referred to as the stagger cylinder, is operable to push alternate rows of bottles at position P2 to the left this one-half bottle diameter distance, as will appear.

As previously noted, the collector plate 155 when in its retracted position extends forward over the trailing (rearward) end of the upper reach 1*a* of the conveyor 1 to the point where the forward end of the plate 155 is adjacent the trailing end of the flight at 3*a* of the conveyor. As shown in FIG. 1, the forward end of the plate 155 is somewhat forward of the trailing end of the flight 3*a.* In the retracted position of the pusher 157 and guide 159, the guide 159 is just slightly forward of the forward end of the retracted plate 155. The collector plate is fed forward from its retracted position as successive rows are pushed forward by the pusher and guide to an advanced position such as shown in FIGS. 15 and 16, in each of which a completed unit U of bottles is shown on the plate. The guide 159, in addition to functioning as a row guide for the infeeding bottles and as a pusher for pushing forward bottles ahead of the guide, also functions as a stripper whereby on retraction of the collector plate from its advanced position of FIG. 16 after a unit U has been collated on the plate, the plate is withdrawn from under the unit and the unit is deposited on the flight at 3*a* (as shown in FIG. 1). Suitable adjustable side guides such as indicated at 377 in FIG. 15A are provided for the units in the 3a zone.

Figure 30:
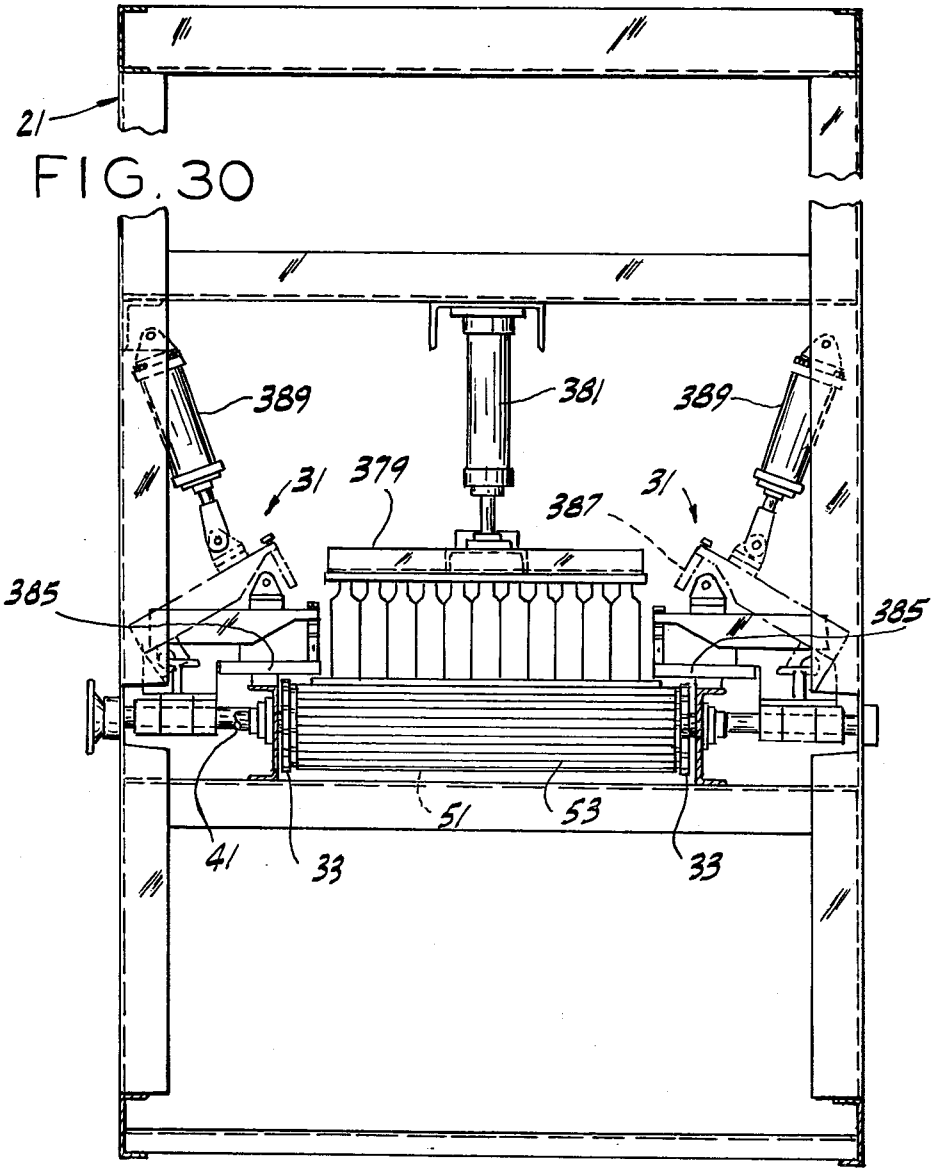
FIG. 30 is an end elevation of the outfeed section.
Figure 29:
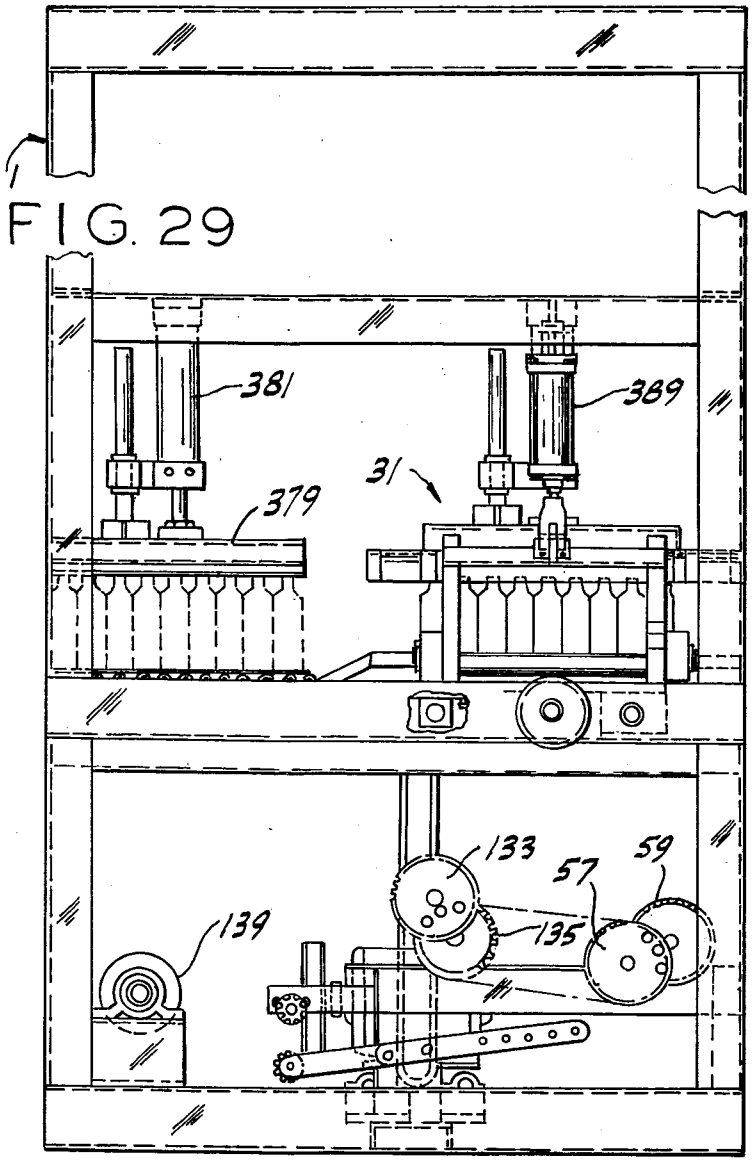
FIG. 29 is a side elevation of the outfeed section.

During the sealing of the film by the anvil 115 and the sealing bar 119, the unit U of bottles on the second conveyor flight position at 3*b* is clamped in position by a clamp 379 actuated by an air cylinder 381 in section 21 (see FIGS. 29 and 30). Also, during each dwell of the conveyor 1, the ends of the sleeve of film wrapped around the unit U on the conveyor flight at the third conveyor flight position at 3*c* are sealed by means of end sealers such as indicated at 31 in section 21. Each end sealer basically comprises a lower jaw 385 and a movable upper jaw 387 operated by an air cylinder 389. The upper jaw has suitable heating means (not shown) incorporated therein.

Figure 24:
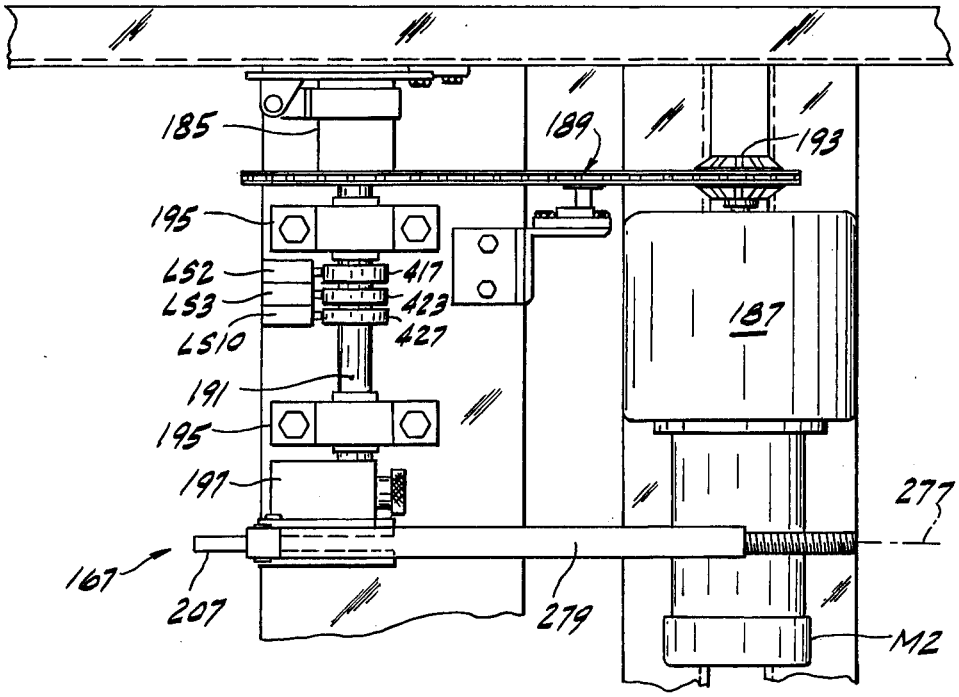
FIG. 24 is a plan of certain drive mechanism of the collating means.
Figure 31:
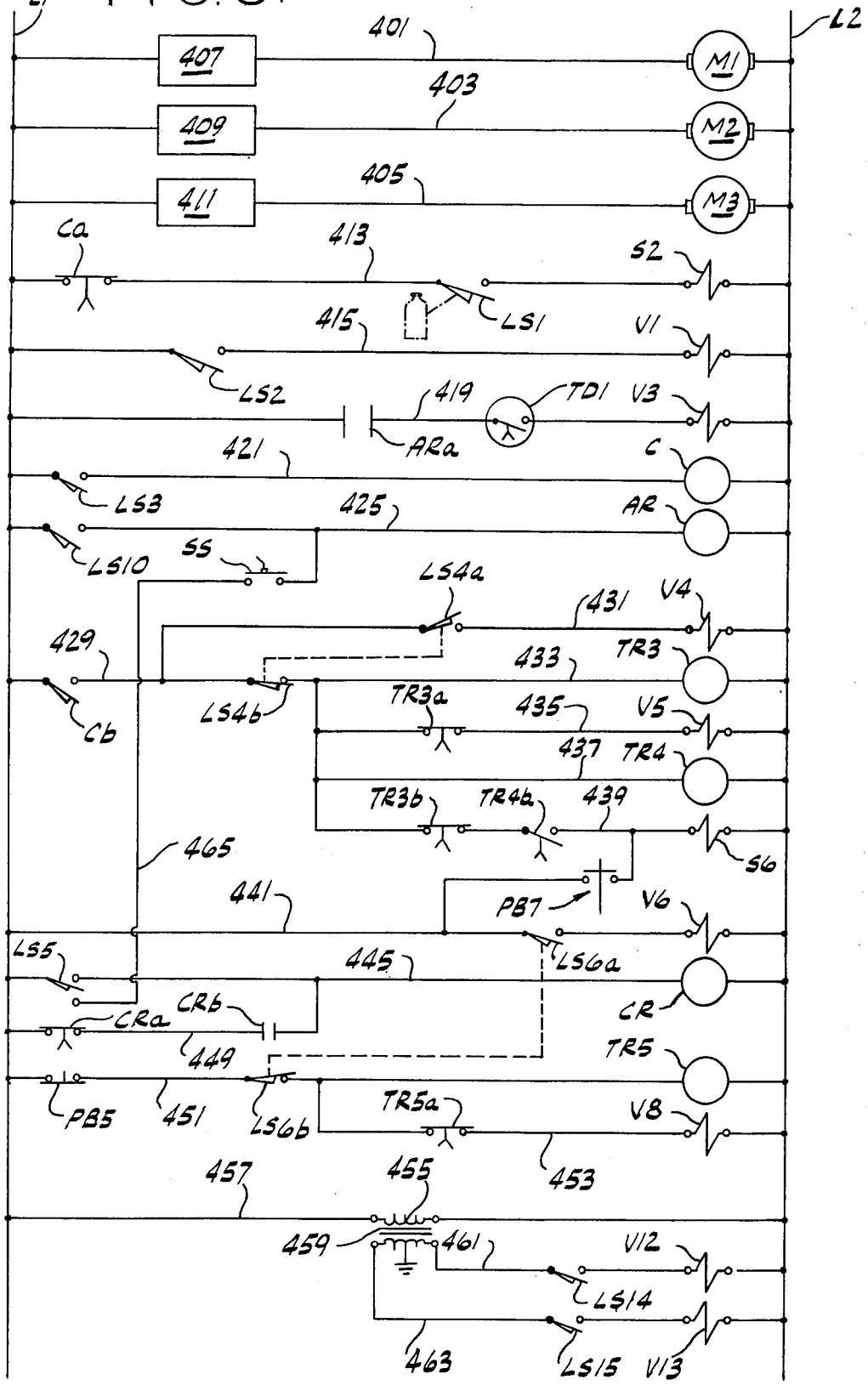
FIG. 31 is a diagram of the electrical circuitry of the apparatus.

Now referring to FIG. 31, the main drive motor M1 (for conveyor 1 and the sealing means 15), the motor M2 for driving the crank 179, and a motor M3 for driving the infeed conveyor 301 are shown as connected between power lines L1 and L2 in lines 401, 403 and 405, respectively, including suitable conventional controls as indicated at 407, 409 and 411. It will be understood that these three motors operate continuously during the operation of the apparatus (except for safety shutdown via suitable safety controls). At S2 is indicated a solenoid of the single revolution clutch 185 for operating the crank 179, connected across lines L1 and L2 in a line 413 including the normally closed contacts Ca of a counter C constituting a row counter, and the switch LS1 which is actuated by the leading bottle B fed across the collector plate 155 by the infeed conveyor 301. Switch LS1 is normally open. At V1 is indicated a solenoid valve which controls the lift cylinder 287 for the row guide 159, connected across lines L1 and L2 in a line 415 including a switch LS2 which is adapted to be actuated by a cam 417 on the shaft 191 for operating the crank 179 (see FIG. 24). This cam is developed and phased so that when the pusher 157 and row guide 159 reach the forward end of their stroke (at the end of the forward stroke of crank 179) the switch LS2 is actuated to energize the valve S1 to operate cylinder 287 to raise the row guide 159 for its return over the bottles to its retracted position along with the pusher, and then to deactuate switch LS2 for deenergizing valve V1 to operate cylinder 287 to lower the row guide 159 for the ensuing operation.

At V3 is indicated a solenoid valve which controls the cylinder 367 for staggering the rows. This valve V3 is connected across lines L1 and L2 in a line 419 including the contacts ARa of a relay AR, which may be referred to as the alternate action relay, and a time delay switch TD1. This circuitry is such that on closure of contacts ARa of the alternate action relay AR valve V3 is energized after a time delay imposed by the time delay switch TD1 to operate the stagger cylinder 367 to extend piston rod 373 and advance the push rod 365 to effect staggering of a row of bottles at position P2.

The counter C (which controls the aforesaid contacts C*a*) is connected across lines L1 and L2 in a line 421 including a switch LS3 which is adapted to be actuated by a cam 423 on the shaft 191. This cam is developed and phased in such manner as to actuate the switch LS3 once each cycle of the crank 179, thereby actuating the switch LS3 once for each row advanced forward. On each actuation of switch LS3, counter C1 is actuated through one step for counting purposes, and when it has counted out a pre-set number of steps (corresponding to the number of rows of bottles desired in a unit U), it opens the contacts C*a* to disable switch LS1 and solenoid S2.

The alternate action relay AR is connected across lines L1 and L2 in a line 425 including a switch LS10 which is adapted to be actuated by a cam 427 on shaft 191. This cam is developed and phased in such manner as to actuate the switch LS10 once each cycle of the crank 179 on the return of the crank to its retracted position, thereby actuating the relay AR once for each row formed and pushed forward. Relay AR functions on alternate actuations thereof (i.e., on every other actuation thereof) to close contacts AR*a* thereby to energize valve V3 (after the return of the pusher 157 and guide 159 to retracted position) to operate the stagger cylinder 367 to stagger a row at position P2, thereby staggering every other row.

At C*b* is indicated a normally open set of contacts of the counter C adapted to close when counter C has counted out the pre-set number of rows to supply power from line L1 via line 429 to five lines 431, 433, 435, 437 and 439 connected to line L2. Line 431 includes a solenoid valve V4 which controls the cylinder 229 for retracting the collector plate 155 and contacts LS4*a* of the switch LS4 (which is actuated by the collector plate on retraction of the collector plate as appears in FIG. 22). Contacts LS4*a* are closed when the collector plate is in any forward position, and are opened when the collector plate is retracted. Line 433 includes a timer relay TR3. Line 435 includes a solenoid valve V5 which controls the cylinder 339 for raising and lowering the front stop 325 and normally closed contacts TR3a of relay TR3. Line 437 includes a timer relay TR4. Line 439 includes a solenoid S6 of the single-revolution clutch 65 for operating the conveyor 1 and sealing means 15, normally closed contacts TR3*b* of relay TR3 and normally open contacts TR4*a* of relay TR4.

At V7 is indicated a solenoid valve for controlling cylinder 381 for operating the clamp 379, this valve being connected across lines L1 and L2 in a line 441 including contacts LS6*a* of a switch LS6 which, as illustrated in FIG. 30, is operated by a cam 443 driven in phase with the indexing means 55 for the conveyor 1. At CR is indicated a reset control of the counter C, connected across lines L1 and L2 in a line 445 including a switch LS5 operated by a cam 447 (FIG. 30) operable in unison with cam 443 in phase with the conveyor 1. Reset CR has a set of normally closed contacts CR*a* and a set of normally open contacts CR*b* in a line 449 shunted around switch LS5. At TR5 is indicated a timer relay connected across lines L1 and L2 in a line 451 including a normally closed push-button switch PB5 and normally closed contacts LS6*b* of switch LS6. At V8 is indicated a solenoid valve for controlling the cylinders 389 of the end sealers 383, connected in a line 453 around relay TR5 including normally closed contacts TR5*a* of relay TR5. At 455 is indicated the primary of a transformer connected across lines L1 and L2 in a line 457. The secondary 459 of this transformer feeds a line 461 including a solenoid valve V12 and a normally open switch LS14. This switch LS14 is actuated by the front stop 325 when the latter is raised, thereby energizing valve V12 which controls cylinder 355 to extend the piston rod 357 for retraction of the front stop 325. The secondary of the transformer also feeds a line 463 including a solenoid valve V13 and the switch LS15. The latter is closed when the front stop is retracted to energize valve V13 which controls cylinder 355 to retract the piston rod 357 to enable extension (forward travel) of the front stop 325.

Switch LS5 is a double throw switch having a movable contactor adapted to close on an upper contact as shown in FIG. 31 to complete a circuit through line 445 and energize the reset CR and on a lower contact to complete a circuit 465 between line L1 and line 425 which includes a selectro switch SS which may be referred to as the even or odd count switch and which is adapted to be set in open or closed position depending on whether a unit is to have an even or odd number or rows. At PB7 is indicated a push-button switch for manual actuation of solenoid S6.

A complete cycle of operation of the apparatus may be regarded as starting with the infeed of bottles by the infeed conveyor 301 through the guide 303 and thence through the space or passage 161 between the pusher 157 and guide 159 to form a first row R1 of bottles for a unit U. The pusher and guide are back in their retracted position of FIG. 1A, and the guide is down. The collector plate 155 is back in its retracted position of FIG. 1A, and the bottoms of the bottles which are pushed along in the passage 161 by the action of the infeed conveyor slide over the plate 155. The bottles are fed one after another across the apparatus (from the left side toward the right side of the apparatus) standing upright on the collector plate. The front stop 325 is in retracted position and down in front of the guide 159. The infeed of bottles through the passage 161 continues until the leading bottle of the infeeding series of bottles engages the arresting means 165 (more particularly the switch and stop arm 313), thereby arresting the infeed of the bottles and providing a row R1 of bottles on the collector plate in position P1 in front of the pusher 157 and behind the guide 159 (see FIG. 1A).

As illustrated in FIGS. 1–16 and 1A, 2A and 5A–15A, the apparatus is set up to provide units U each consisting of five rows of bottles with 10 bottles in each row, but it will be understood that this is merely by way of illustration and that the apparatus may be set up to form units with different numbers of rows and different numbers of bottles in each row. FIGS. 1–16 and 1A, 2A and 5A–15A are generally diagrammatic to simplify the illustration of the apparatus; generally a row will consist of more than 10 bottles (as will appear from FIG. 21) and there will be more than five rows in a unit U. The number of bottles in a row is determined by the adjustment of the length of the pusher 157, and the number of rows is determined by the setting of the counter C.

When the leading bottle engages arm 313, switch LS1 is actuated to energize solenoid S2 (relay contacts *Ca* being closed), thereby engaging the single-revolution clutch 185 to drive shaft 191 through a single revolution to drive the crank through a cycle involving a forward stroke of the crank followed by a return stroke. On the forward stroke of the crank, rod 277 drives the pusher 157 (and guide 159) forward a distance corresponding to the forward travel of the pin 281 and rod 209 drives the collector plate 155 forward a distance corresponding to the forward travel of pin 213, which is less than the forward travel of pin 281. The collector plate is driven forward via the forward thrust of rod 209 causing the eccentric 219 to rotate into gripping engagement with the rod to couple the collector plate to the rod. The stroke of the crank 179 is so adjusted in relation to the diameter of the bottles being handled that the pusher 157 is driven forward a distance somewhat greater than the bottle diameter, and thus pushes row R1 forward from its position and P1 as illustrated in FIG. 1A a distance somewhat greater than the bottle diameter, bringing row R1 to the P2 position as illustrated in FIGS. 2 and 2A. As the pusher 157 moves forward, gate 321 on the infeed end of the pusher blocks off the further infeed of bottles (see FIG. 2A).

The row guide 159 may be down as it moves forward with the pusher 157. It engages the front stop 325, which is free to move forward, and pushes the front stop forward (see FIGS. 2 and 2A). Toward the end of the forward stroke of the crank 179, i.e., the end of the forward stroke of the pusher 157 and the row guide 159, cam 417 (FIG. 24) actuates switch LS2 (see FIG. 31), thereby energizing valve V2 for the row guide cylinder 287 to retract the piston rod 289 of this cylinder and lift the row guide 159 to the raised position in which it is shown in FIG. 3 clear of the bottles in the row R1 standing on the collector plate 155. the crank 179 then swings back through its return stroke, and acts via rod 277 to pull the pusher 157 and guide 159 back to their retracted position as illustrated in FIG. 4. Cam 417 then effects deactuation of switch LS2 for operating the cylinder 287 to drive the guide down to its lowered operative position as shown in FIG. 5. On the return stroke of the crank 179, the rod 209 is returned rearward, but does not pull the collector plate 155 rearward; plate 155 remains forward in its FIG. 2A position via disengagement from the rod 209 of the eccentric or gripper 219.

On the return of the pusher 157 and guide 159 to their retracted position and the lowering of the guide as shown in FIGS. 5 and 5A, a second row R2 of bottles is fed in through the passage 161 between the pusher and guide at position P1. This infeed of the second row starts when the gate 321, moving rearward with the pusher, moves rearward of the series of bottles at the left side of the apparatus being urged to move in the direction of the arrow shown in FIG. 5A by the infeed conveyor 301.

Figures 6A, 7, 7A, 8, 8A, 9, 9A:
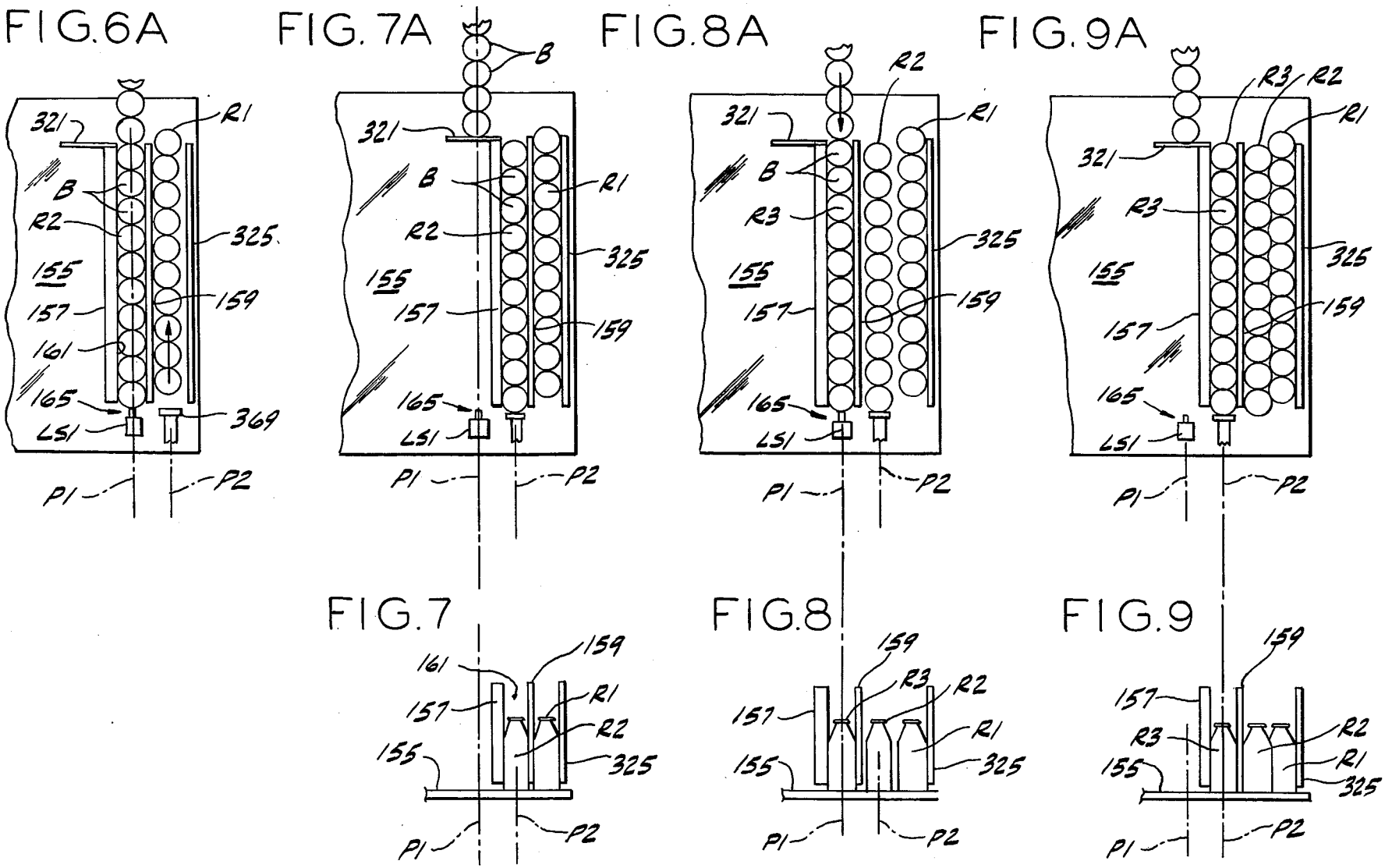

As the shaft 191 rotates through its single revolution (following the actuation of switch LS1 by the leading bottle of row R1), cam 423 actuates switch LS3 to pulse the counter C once for the first row R1. Also, cam 427 actuates switch LS10 to energize the alternate action relay AR. This results in closure of the relay contacts AR*a* in line 419. When contacts AR*a* close, time delay switch TD1 in line 419 starts timing out a delay interval such as to delay closure of switch TD1 until the row R1 of bottles has been pushed forward to the P2 position. Then, upon this delayed closure of switch TD1 (and with contacts AR*a* closed), valve V3 is energized to operate the stagger cylinder 367 to drive the push rod 365 through a forward stroke (toward the left as viewed in FIG. 21) thereby moving the row R1 of bottles at position P2 toward the left side of the apparatus a distance corresponding to one-half the bottle diameter so as to stagger row R1 relative to now R2 as illustrated in FIG. 6A. After this has occurred, valve V3 is deenergized by the opening of contacts AR*a* to operate cylinder 367 to retract the push rod 365. This staggering of row R1 occurs while row R2 is being fed in.

When the leading bottle of row R2 being fed in at position P1 engages arm 313, the infeed is arrested and switch LS1 is actuated to energize solenoid S2 for a second cycle of the crank 179. The pusher 157 and guide 159 are thereupon driven forward through a forward stroke, pusher 157 acting to push forward the row R2 from position P1 to position P2 and guide 159 acting to push forward row R1 to the position in which it is shown in FIGS. 7 and 7A. The row R1 engages and pushes forward the front stop 325 to its FIGS. 7 and 7A position. The collector plate 155 is driven forward through its index distance (which is somewhat less than the stroke of the pusher and guide) to its FIGS. 7 and 7A position thereby to support row R2 at the P2 position. Switch LS2 is actuated for raising the guide 159, the pusher 157 and guide 159 return to their retracted position, and the guide is lowered, as shown in FIG. 8. On the return of the pusher and guide and the lowering of the guide, as shown in FIGS. 8 and 8A, a third row R3 of bottles is fed in through the passage 161 between the pusher and guide at position P1. While cam 423 on shaft 191 actuates switch LS10 and pulses the alternate action relay AR when the rows R2 and R1 are pushed forward, contacts AR*a* remain open (relay AR being an alternate action relay). Thus, row R2 remains in its position of FIG. 8A while row R3 is being fed in, and rows R1 and R2 remain staggered one relative to the other.

When the leading bottle of row R3 being fed in at position P1 engages arm 313, the infeed is arrested and switch LS1 is actuated to energize solenoid S2 for a third cycle of the crank 179. The pusher 157 and guide 159 are driven forward from the FIGS. 8 and 8A position to the FIGS. 9 and 9A position, the pusher acting to push row R3 forward to position P2, and the guide acting to push rows R2 and R1 forward. The collector plate 155 is indexed forward to its FIGS. 9 and 9A position thereby to support the three rows. The row R2 is driven farther forward by the guide than the collector plate is indexed forward so that, with row R1 engaging the front stop 325, row R2 is nested into row R1 as appears in FIG. 9A. On the return of the pusher and guide and the lowering of the guide, as shown in FIGS. 10 and 10A, a fourth row R4 of bottles is fed in through the passage 161 between the pusher and guide at position P1. Again cam 423 on shaft 191 actuates switch LS10 and pulses the alternate action relay AR. This time contacts AR*a* are closed to energize valve V3 (after the time delay imposed by time delay switch TD1) to operate the stagger cylinder 367 to drive the push rod 365 through a forward stroke thereby moving the row R3 of bottles at position P2 toward the left side of the apparatus a distance corresponding to one-half the bottle diameter so as to stagger row R3 relative to row R2 and row R4 (see FIG. 10A). After this has occurred, valve V3 is deenergized to operate cylinder 367 to retract the push rod 365. This staggering of row R3 occurs while row R4 is being fed in (see FIG. 10A).

When the leading bottle of row R4 being fed in at position P1 (see FIGS. 10 and 10A) engages arm 313, the infeed is arrested and switch LS1 is actuated to energize solenoid S2 for a fourth cycle of the crank 179. The pusher 157 and guide 159 are driven forward from the FIGS. 10 and 10A position to the FIGS. 11 and 11A position, the pusher acting to push row R4 forward to position P2, and the guide acting to push rows R3, R2 and R1 forward. The collector plate 155 is indexed forward to its FIGS. 11 and 11A position thereby to support the four rows. The row R3 is driven farther forward than the advance of the collector plate so that, with row R1 engaging the front stop, and row R2 nested into row R1, row R3 is nested into row R2 as appears in FIG. 11A. On the return of the pusher and guide and the lowering of the guide, as shown in FIGS. 12 and 12A, a fifth row R5 of bottles is fed in through the passage 161 between the pusher and guide at position P1. Again cam 423 on shaft 191 actuates switch LS10 and pulses the alternate action relay AR. This time contacts AR*a* remain open, so that row R4 remains in its position of FIG. 12A, while row R5 is being fed in, so that the row R4 remains staggered relative to row R3 and row R5.

Figure 14A:
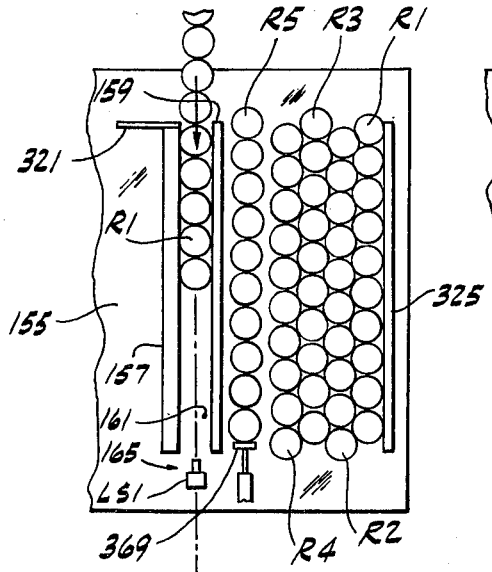
FIG. 14A is a plan of FIG. 14.
Figure 14:
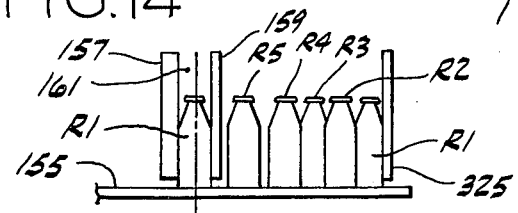

When the leading bottle or row R5 being fed in at position P1 (see FIGS. 12 and 12A) engages arm 313, the infeed is arrested and switch LS1 is actuated to energize solenoid S2 for a fifth cycle of the crank 179. The pusher 157 and guide 159 are driven forward from the FIGS. 12 an 12A position to the FIGS. 13 and 13A position, the pusher acting to push row R5 forward to position P2, and the guide acting to push rows R4, R3, R2 and R1 forward. The collector plate 155 is driven forward to its FIGS. 13 and 13A position thereby to support the five rows. The row R4 is driven farther forward than the advance of the collector plate so that, with row R1 engaging the front stop, row R2 nested into R1 and row R3 nested into row R2, row R4 is nested into row R3 as appears in FIG. 13A. On the return of the pusher and guide and the lowering of the guide, as shown in FIGS. 14 and 14A, a row R1 of bottles for the next unit U is fed in through the passage 161 between the pusher and guide at position P1. Again cam 423 on shaft 191 actuates switch LS10 and pulses the alternate action relay AR. This time contacts AR*a* are closed to energize valve V3 (after the time delay imposed by time delay switch TD1) to operate the stagger cylinder 367 to drive the push rod 365 through a forward stroke thereby moving the row R5 of bottles at position P2 toward the left side of the apparatus a distance corresponding to one-half the bottle diameter so as to stagger row R5 relative to row R4 (see FIG. 14A). After this has occurred, valve V3 is deenergized to operate cylinder 367 to retract the push rod 365. This staggering of row R5 occurs while row R1 for the next unit is being fed in (see FIG. 14A).

On the advance of each successive row R1 – R5 by the pusher 157, i.e., on each successive revolution of the shaft 191 and each cycle of the crank 179, counter C is pulsed via the actuation of switch LS3 by cam 423 in effect to count the number of rows which have been formed and pushed forward. The counter C is set to open contacts C*a* when it has counted out the number of rows (e.g., five) for a unit U, and to maintain contacts C*a* open until it is reset by the operation of the reset control CR. This opening of contacts C*a* deactivates solenoid S2 and thus deactivates the clutch 185 to deactivate the crank 179 until the ensuing cycle.

In addition to opening its contacts C*a* when it has counted out the pre-set number of rows (e.g., five rows), counter C closes its contacts C*b* in line 429. Upon closure of contacts C*b*, valve V4 is energized via line 431 (contacts LS4*a* of switch LS4 being closed at this time due to the collector plate 155 having been advanced) and this operates cylinder 229 to effect return of the collector plate to the retracted position in which it is shown in FIGS. 1, 1A and 15A. During the initial phase of the return movement of the collector plate 155 (involving movement of the collector plate to the left from its FIGS. 14 and 14A position to its FIGS. 1, 1A and 15A position), rows R4, R3, R2 and R1 of bottles are carried back rearward by the collector plate until row R4 nests into row R5 and then the five rows are held against rearward movement by the guide 159 which acts as a stripper while the collector plate moves out from under the five rows, with the result that the five rows, now completely nested, drop down onto the conveyor flight at 3*a* (see FIGS. 1 and 15A). The forward edge of the collector plate comes back under the guide 159 for this purpose, and this stripping or bottle deposition action occurs with the pusher 157 and guide 159 in their retracted position, with bottles being fed in therebetween at position P1 to form row R1 of the next ensuing unit U.

Upon its return to its retracted position, collector plate 155 opens contacts LS4*a* of switch LS4 to deenergize valve V4 and closes contacts LS4*b* of switch LS4 to supply power for lines 433, 435, 437 and 439. Valve V5 is energized via line 435 (relay contacts TR3*a* at first being closed) and operates cylinder 339 to elevate the front stop 325. When this stop is elevated, it actuates switch LS14, thereby energizing valve V12 to operate cylinder 355 to extend its piston rod 357 to retract the front stop. The time delay relay TR3, having been energized on closure of contacts LS4*b* of switch LS4, times out a delay interval for delaying opening of contacts TR3*a* until the front stop 325 has been retracted; then contacts TR3*a* open to deenergize valve V5 to operate the cylinder 339 to lower the front stop 325.

Also, when contacts LS4B close, time delay relay TR4 is energized and, after its time delay, closes its contacts TR4*a* in line 439. Contacts TR3*b* being closed at this time, solenoid S6 is energized to actuate the single-revolution clutch 65 to drive sprocket 59 through a single revolution for the indexing of conveyor 1 and the operation of the anvil 115 and seal bar 119 to sleeve-wrap the unit U on conveyor flight 3*a*. Once this has started, contacts TR3*b* open (afer relay TR3 has timed out its interval) to de-energize solenoid S6, the clutch 65 remaining in operation to complete its single-revolution cycle.

As the sprocket 59 rotates through its single-revolution cycle, carrying the offset sprocket 57 around with it, it acts via the drive 61 to drive the conveyor 1 to index the upper reach 1*a* of the conveyor forward to move the conveyor flight carrying the completed unit or set of bottles U (consisting of the five nested rows R1 – R5) from the position at 3*a* through the sealing station S to the position at 3*b*, to move the flight which was at 3*b* to 3*c* and to bring a gap 5 to the sealing station S. Reference may be made to my aforesaid U.S. Pat. No. 3,927,507 and application Ser. No. 619,897 for full detail as to the mode of operation of the conveyor drive. The unit U rests on the web F1 on flight 3*a*, this web F1 being sealed downstream from unit U to the web F2 at a leading seal S1 (see FIG. 1). As the unit U moves forward through the sealing station S to position 3*b*, the upper web F2 becomes draped over the unit, the lower web F1 already being draped under the unit (see FIG. 15). The conveyor 1 stops when the unit U reaches the 3*b* position (see FIG. 15), and then the drive mechanism 135, 133, 141 etc. for the sealing means 15 acts to close the anvil 115 and sealing bar 119 on the webs F1 and F2 behind the unit U at 3*b* as shown in FIG. 16 to effect heat-sealing together of the webs and severing of the webs through the seal (similar to the operation disclosed in my aforesaid U.S. Pat. No. 3,927,507) so as to provide a trailing seal S2 for the film draped around the unit at 3*b* and a seal S1 constituting a leading seal for the next operation. The sealing bar 119 moves up through the gap 5 in the upper reach 1*a* of the conveyor at the sealing station, and the webs F1 and F2 are sealed just above the level of the upper reach of the conveyor. The anvil 115 and seal bar 119 then open, the bar 119 descending below the upper reach of the conveyor to enable the conveyor to index in the ensuing operation.

Cam 443 functions to actuate switch LS6 to open contacts LS6*a* to deenergize valve V7 to operate cylinder 381 to raise the clamp while the conveyor 1 is moving and to close contacts LS6*a* to energize valve V7 to operate cylinder 381 to lower the clamp when the conveyor dwells so as to clamp the unit U at position 3*b* (i.e., to clamp it on top of the film F2) while the films are being sealed at the sealing station S. Contacts LS6*b* close to energize the timer relay TR5 to close its contacts TR5*a* to energize valve V8 for an interval during the dwell of the conveyor to actuate the cylinders 389 to operate the end sealers 31 to seal the ends of the wrapper of the unit at position 3*c*.

Cam 447 functions to actuate switch LS5 to actuate the reset control CR in response to the indexing of the conveyor. The reset control CR thereupon functions to reset the counter C to zero for starting the counting of the rows of the next unit. On reset of counter C, its contacts C*a* close to re-activate the solenoid S2 for actuation by switch LS1 for collating the next unit. The procedure is repeated, the next unit being collated and transported forward by the conveyor for being sleeve-wrapped in the same manner as above described. On each indexing of the conveyor, the enwrapped and end-sealed unit U which was at position 3*c* is delivered to the shrink tunnel 29 and transported therethrough by the conveyor 27 for being shrunk by heat in the tunnel.

On each actuation of switch LS5 to actuate the reset control CR for the counter C, the movable contactor of switch LS5 closes momentarily on its lower contact and thereby supplies power to line 465. Noting that units U have an odd number of rows, switch SS is closed so that LS5 pulses the alternate action relay in effect to skip a step so that, after having staggered the fifth and last row of the odd-numbered-row unit, the first row of the next unit will be staggered. Switch SS is opened for forming even-numbered-row units. Thus, as to a six-row unit, for example, the first, third and fifth rows will be staggered, the second, fourth and sixth will not be staggered, and since the sixth is not staggered, the collating means is automatically conditioned to stagger the first row of the next unit.

From the above it will appear that the apparatus functions automatically to assembly or collate the bottles B in sets or units U each consisting of a predetermined number of bottles arranged in parallel rows, each row comprising a plurality of bottles arranged side-by-side. Cylindrical bottles may be collated with the articles in each row nested in relation to the articles in the adjacent row or rows to minimize the voids in each unit by utilization of the stagger cylinder 367 and pusher 365 and the associated controls. Square bottles and blakes may be collated without staggering. Each unit is individually sleeve-wrapped and, with its wrapper shrunk, constitutes a stable package wherein the bottles are retained as collated. It will be understood that in some instances the row guide 159 may be raised before or during the forward stroke of the pusher 157 and guide 159.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for packing articles such as bottles in units with the articles in each unit arranged in parallel rows, each row comprising a plurality of articles arranged side-by-side, said apparatus comprising:

means for supporting articles for arrangement thereof in rows;

means mounting said supporting means for movement in a predetermined path generally at right angles to the length of the rows on said supporting means, said supporting means being movable forward along said path from a rearward retracted position;

a pusher for pushing rows of articles on said supporting means forward in said path generally at right angles to the length of the rows, said pusher being movable forward along said path from a rearward retracted position through a forward stroke and back through a return stroke to its retracted position;

a guide movable forward and back with the pusher and spaced forward of the pusher a distance such as to provide a space for a row of articles therebetween, said guide also being movable relative to the pusher between a lowered operative position at the level of the rows and a raised position above the rows;

means for feeding articles in single file one after another over said supporting means from one side of said path through said space when the pusher and guide are in their retracted position and the guide is lowered;

means for arresting the feeding of the articles to provide a row of articles on said supporting means in said space in a first position in front of the pusher;

means responsive to the arresting of feeding of the articles for driving the pusher and guide through a forward and return stroke whereby the pusher pushes the row of articles in front of the pusher forward to a second position and for simultaneously driving said supporting means forward through a predetermined forward stroke thereby to collate articles in rows on said supporting means;

means for moving the guide to its raised position so that, on its return with the pusher, the guide clears the articles in said second position;

presettable means for determining the number of rows of articles to be collated on said supporting means for a unit; and means responsive to said presettable means when it has determined the number of rows for a unit and the pusher and guide have been retracted and the guide lowered for retracting said supporting means to remove the support for the unit, the unit then being held against rearward movement by the guide.

2. Apparatus as set forth in claim 1 for packing cylindrical articles such as bottles standing upright in staggered rows with the articles in each row nested in relation to the articles in the adjacent row or rows, said apparatus having means operable on alternate rows of articles at said second position to move the row in the direction of its length such a distance in relation to the diameter of the articles as to stagger the rows for nesting.

3. Apparatus as set forth in claim 2 having a front stop ahead of the guide engageable by the leading row of articles and movable forward from a rearward retracted position by articles being moved forward by the guide, and means for moving the stop to its retracted position.

4. Apparatus as set forth in claim 3 wherein the means for driving the pusher and guide and said supporting means comprises means for driving said supporting means forward through a predetermined stroke which is shorter than the stroke of the pusher and guide for nesting of the row being pushed forward by the guide with respect to the next row forward.

5. Apparatus as set forth in claim 4 wherein the stop is movable to a raised position clear of the articles, and wherein means is provided for raising the stop to its raised position after completion of each unit.

6. Apparatus as set forth in claim 5 wherein said arresting means comprises means located at the other side of said path engageable by the leading article of the articles being fed over the supporting means, and said staggering means comprises a pusher engageable with the article at the end of the row in said second position at said other side of said path.

7. Apparatus as set forth in claim 1 further comprising an endless conveyor having an upper reach for transporting the completed units, said supporting means being adapted to hold each unit over the trailing end of the upper reach of the conveyor and being retractable from over said reach while holding the unit against movement with the supporting means to cause the unit to drop down onto said reach.

8. Apparatus as set forth in claim 1 further comprising means for wrapping the units, said wrapping means comprising an endless conveyor having an uppper reach for transporting the units for being wrapped, said conveyor being operable in cycles with a dwell between successive cycles, said supporting means being adapted to hold each unit over the trailing end of the upper reach of the conveyor and being retractable from over said reach while holding the unit against movement with the supporting means to cause the unit to drop down onto said reach during a dwell of the conveyor, said wrapping means being adapted to sleeve-wrap each unit, said conveyor having a series of flights for supporting the units spaced at intervals along the length of the conveyor with gaps between the flights, means for intermittently indexing the conveyor forward through a distance equal to one of said intervals with a dwell between successive cycles of operation successively to bring a gap in the conveyor to a sealing station located along said path, whereby, during each dwell of the conveyor between cycles, there is a gap at the sealing station, a flight at a first position upstream from the sealing station and a flight at a second position downstream from the sealing station, the flight at the first position being adapted to receive a unit to be wrapped and to transport it, on indexing of the conveyor, through the sealing station to the second position, means for supplying a first web of heat-sealablewrapping material to extend over the conveyor and under a unit as the unit proceeds to the second position, means for supplying a second web of heat-sealable wrapping material to lie on top of a unit as it proceeds to the second position, and means for sealing the two webs together at said sealing station and severing the webs through the seal to form a trailing seal for the webs draped around the unit at the second position and a leading seal for the unit at the first position, said sealing means being operable through the gap in the endless conveyor at the sealing station during each dwell of the conveyor.

9. Sleeve-wrapping apparatus as set forth in claim 8 wherein the sealing means comprises an upper and a lower sealing member movable vertically relative to one another in a vertical plane transverse to the conveyor at the gap at the sealing station from an open position to a closed position engaging the webs at the sealing station.

10. Apparatus as set forth in claim 9 wherein said supporting means comprises a plate movable forward from a retracted position in the direction of said path over said flight at said first flight position.

11. Apparatus as set forth in claim 10 for packing cylindrical articles such as bottles standing upright in staggered rows with the articles in each row nested in relation to the articles in the adjacent row or rows, said apparatus having means operable on alternate rows of articles on said plate at said second position to move the row in the direction of its length such a distance in relation to the diameter of the articles as to stagger the rows for nesting.

12. Apparatus as set forth in claim 11 having a front stop ahead of the guide engageable by the leading row of articles and movable forward from a rearward retracted position by articles being moved forward by the guide, and means for moving the stop to its retracted position.

13. Apparatus as set forth in claim 12 wherein said driving means comprises means for driving said plate forward through a predetermined stroke which is shorter than the stroke of the pusher and guide for nesting of the row being pushed forward by the guide with respect to the next row forward.

14. Apparatus as set forth in claim 12 wherein the stop is movable to a raised position clear of the articles, and wherein means is provided for raising the stop to its raised position after completion of each unit.

15. Apparatus as set forth in claim 14 wheren said arresting means comprises means located at the other side of said path engageable by the leading article of the articles being fed over the plate, and said staggering means comprises a pusher engageable with the article at the end of the row in said second position at said other side of said path.

16. Apparatus as set forth in claim 15 operable to form units with either an even or an odd number of rows and having means operable when the last row of a unit having an odd number of rows is staggered to stagger the first row of the next unit.

* * * * *